US007618037B2

(12) United States Patent
Kang et al.

(10) Patent No.: US 7,618,037 B2
(45) Date of Patent: Nov. 17, 2009

(54) PAPER FEEDING APPARATUS OF IMAGE FORMING DEVICE AND PAPER FEEDING METHOD THEREOF

(75) Inventors: Hoon Kang, Hwaseong-si (KR); Duk-soo Kim, Suwon-si (KR); Dae-ho Kim, Anyang-si (KR)

(73) Assignee: Samsung Electronics Co., Ltd., Suwon-si (KR)

( * ) Notice: Subject to any disclaimer, the term of this patent is extended or adjusted under 35 U.S.C. 154(b) by 427 days.

(21) Appl. No.: 11/452,208

(22) Filed: Jun. 14, 2006

(65) Prior Publication Data

US 2007/0013121 A1 Jan. 18, 2007

(30) Foreign Application Priority Data

Jul. 12, 2005 (KR) ..... 10-2005-0062966

(51) Int. Cl.
*B65H 1/26* (2006.01)
*B65H 3/44* (2006.01)
*B65H 5/26* (2006.01)

(52) U.S. Cl. ..... 271/157; 271/9.12; 271/158; 271/9.01

(58) Field of Classification Search ..... 271/9.01, 271/157, 158, 9.12, 171
See application file for complete search history.

(56) References Cited

U.S. PATENT DOCUMENTS 5,102,112 A * 4/1992 Takahashi ..... 271/9.08
5,150,893 A * 9/1992 Uno et al. ..... 271/157
5,335,903 A * 8/1994 Martin et al. ..... 271/157

(Continued)

FOREIGN PATENT DOCUMENTS

JP 01053937 * 3/1989

(Continued)

*Primary Examiner*—Patrick H Mackey
*Assistant Examiner*—Patrick Cicchino
(74) *Attorney, Agent, or Firm*—Stein McEwen, LLP

(57) ABSTRACT

The paper feeding apparatus includes a paper feeding cassette having a side guide part for defining and setting a lateral size of paper, a rear guide part for defining and setting a longitudinal size of paper, and a first and second load part for simultaneously or separately accommodating paper sheets; a first lifting unit installed to the paper feeding cassette for lifting the first load part; a second lifting unit installed to the paper feeding cassette for lifting the second load part; a paper feeding unit for picking up and feeding the paper sheets loaded on the first load part sheet by sheet when the first load part is lifted up; a paper transfer unit installed in the paper feeding cassette for transferring paper sheets loaded on the second load part to the first load part; and a paper detection unit for checking whether each of the first and second parts is loaded with paper sheets and whether paper sheets are loaded simultaneously on the first and second load parts in a shared manner. The first and second lifting units are controlled to lift at least one of the first and second load parts according to determination whether paper sheets are loaded simultaneously on the first and second load parts in a shared manner, and the paper transfer unit is controlled to transfer paper sheets on the second load part to the first load part according to determination whether each of first and second load parts is loaded with paper sheets.

25 Claims, 11 Drawing Sheets

U.S. PATENT DOCUMENTS

| | | | | |
|---|---|---|---|---|
| 5,971,387 | A * | 10/1999 | Kita | 271/9.03 |
| 6,123,329 | A * | 9/2000 | Sato et al. | 271/9.01 |
| 6,332,609 | B1 * | 12/2001 | Arakawa | 271/157 |
| 6,585,254 | B2 * | 7/2003 | Hsieh | 271/127 |
| 6,603,952 | B2 * | 8/2003 | Hoene et al. | 399/393 |
| 2004/0195757 | A1 * | 10/2004 | Lyu et al. | 271/110 |
| 2005/0133983 | A1 * | 6/2005 | Jacobs et al. | 271/145 |
| 2007/0132170 | A1 * | 6/2007 | Butler | 271/9.01 |

FOREIGN PATENT DOCUMENTS

| | | | |
|---|---|---|---|
| JP | 03195639 | * | 8/1991 |
| JP | 4-28635 | | 1/1992 |
| JP | 4-101934 | | 4/1992 |
| JP | 4-338035 | | 11/1992 |
| JP | 04338035 | * | 11/1992 |
| JP | 06100184 | * | 4/1994 |
| JP | 07-309459 | | 11/1995 |
| KR | 130754 | | 11/1997 |

* cited by examiner

PAPER FEEDING APPARATUS OF IMAGE FORMING DEVICE AND PAPER FEEDING METHOD THEREOF

CROSS-REFERENCE TO RELATED APPLICATIONS

This application claims all benefits accruing under 35 U.S.C. §119 from Korean Application No. 2005-62966, filed on Jul. 12, 2005, in the Korean Intellectual Property Office, the disclosure of which is incorporated by reference herein.

BACKGROUND OF THE INVENTION

1. Field of the Invention

The present invention relates to an image forming device, and more particularly, relates to a paper feeding apparatus for use in an image forming device and a paper feeding method thereof.

2. Related Art

Generally, an image forming device, such as a printer, a copier, a facsimile machine and a multi-functional product, is equipped with a paper feeding cassette for accommodating a stack of printable media, such as paper sheets to be used when forming images. The paper feeding cassette is detachably or slidably mounted in a main body of an image forming device so that it is entirely or partially exposed outside the main body whenever new paper sheets are loaded therein or paper sheets accommodated in the cassette are replaced with new ones.

The paper feeding cassette can be classified into a single-size cassette in which only a single size of paper can be loaded therein, and a universal cassette in which a variety size of paper sheets can be loaded therein and adjustment can be made to accommodate paper sheets of a different size.

The single-size cassette has the advantage in that paper sheets can be reliably fed into an image forming device with little or no errors, since a paper size of the cassette is fixedly set; however, such a single-size cassette also has the disadvantage in that multiple cassettes are necessary, if paper sheets of different sizes are to be fed into the image forming device. As a result, a large storage space is required to store a large number of cassettes. In addition, there is another disadvantage in that the cassette mounted in an image forming device should be inconveniently replaced with another cassette whenever an image is needed to be formed on a paper sheet of a different size.

In contrast to the single-size cassette, a universal cassette is more desirable and is widely used to accommodate paper sheets of a variety of sizes for use in an image forming device.

FIG. 1 illustrates a typical universal cassette 1 having a side guide part used for setting a lateral size of paper sheets and guiding sides of the paper sheets, and a rear guide part used for setting a longitudinal size of paper sheets and guiding rear ends of the paper sheets.

The universal cassette 1 includes a casing 10, a knock-up plate 12 coupled to both sides of the casing 10, via pins 13, such that it is pivotable in the vertical direction for receiving paper sheets thereon, a side guide part 14 having a pair of side guides installed in the casing 10 such that it is slidably moved in the lateral direction of the paper sheets, while supporting both side edges of the paper sheets placed on the knock-up plate 12, a rear guide part 16 installed in the casing 10 such that it conducts a serration movement in the longitudinal direction of the paper sheets, while supporting rear edges of the paper sheets placed on the knock-up plate 12, and a pair of finger members 17 for pressing down front corners of the paper sheets guided by the side guide part 14 and the rear guide part 16 and placed on the knock-up plate 12.

A spring 18 is provided under the knock-up plate 12 for pushing up the knock-up plate 12 as the paper sheets are being fed into the image forming device. Further, a rack 15 is provided under the side guide part 14; and a pinion (not shown) is disposed between the rack 15 and the side guide part 14 and geared with the rack 15 and the side guide part 14 for facilitating the side guide part 14 to move slidably.

Hereinafter, the paper load and replacement operations for the conventional universal cassette 1 will be described in detail as follows.

First, the universal cassette 1 is separated from its mount position in a main body of an image forming device and moved to be exposed entirely or partially so that paper sheets can be loaded or replaced.

Next, the side guides of the side guide part 14 are adjusted to be disposed far away enough from each other so that paper sheets can be easily introduced into the cassette 1, and paper sheets are newly introduced into the cassette 1 or the paper sheets accommodated in the cassette 1 are replaced with new ones.

After introduction or replacement of paper sheets, the side guide part 14 is moved in the direction of an arrow "I", thereby supporting both sides of the paper sheets. The rear guide part 16 is moved in the direction of an arrow "H", thereby supporting rear ends of the paper sheets.

In this instance, the front ends of the paper sheets are adjusted to be aligned with a front end of the knock-up plate 12, and the front ends of the paper sheets are interposed between the knock-up plate 12 and the finger members 17.

The introduced paper sheets in the above described manner are in ready to be fed into the image forming device, when an uppermost paper sheet is pressed against the finger members 17 due to an elastic force of the spring 18 installed under the knock-up plate 12.

Finally, the universal cassette 1 is mounted again in the main body of the image forming device after the paper sheets are loaded in the cassette 1.

However, such a conventional universal cassette 1 has the following disadvantages. First, since position of the rear guide part 16 is adjusted by a serration motion when setting a paper accommodation size of the cassette 1, it is difficult to move the rear guide part 16. Second, in the case in which the universal cassette 1 accommodates paper sheets having a smaller size than the largest size that can be accommodated in the cassette 1, for example, the universal cassette 1 accommodates paper sheets having a half size of the largest size, there can be an empty space in the universal cassette 1, particularly at a rear side of the accommodated paper sheets. However, such an empty space remains unused. Even if a redundant empty space at a rear side of the cassette 1 is used, that is, in case of accommodating paper sheets even in the redundant empty space, the paper sheets accommodated in the redundant empty space can be fed into the image forming device after paper sheets accommodated at the front portion of the cassette 1 are run out. Accordingly, the number of paper supply times can be made smaller, resulting in avoidance of inconvenience of supplying paper sheets frequently. However, the above described paper accommodation technique can not be applied to the conventional universal cassette 1.

SUMMARY OF THE INVENTION

Several aspects and example embodiments of the present invention provide a paper feeding apparatus and method of an image forming device in that paper sheets having a variety of paper sizes can be easily loaded and paper accommodation capacity for paper sheets can be enhanced.

Additional aspects and/or advantages of the invention will be set forth in part in the description which follows and, in part, will be obvious from the description, or may be learned by practice of the invention.

In accordance with an embodiment of the present invention, a paper feeding apparatus is provided for use in an image forming device, comprising: a paper feeding cassette having a side guide part for defining and setting a lateral size of paper, a rear guide part for defining and setting a longitudinal size of paper, and first and second load parts for simultaneously or separately accommodating paper sheets; a first lifting unit installed in the paper feeding cassette for lifting the first load part; a second lifting unit installed in the paper feeding cassette for lifting the second load part; a paper feeding unit for picking up and feeding the paper sheets loaded on the first load part sheet by sheet, when the first load part is lifted up; a paper transfer unit installed in the paper feeding cassette for transferring paper sheets loaded on the second load part to the first load part; and a paper detection unit for checking whether each of the first and second load parts is loaded with paper sheets and whether paper sheets are loaded simultaneously on the first and second load parts in a shared manner.

According to an aspect of the present invention, the first and second lifting units are controlled to lift at least one of the first and second load parts according to determination whether the paper sheets are loaded simultaneously on the first and second parts in a shared manner; and the paper transfer unit is controlled to transfer paper sheets on the second load part to the first load part according to determination whether each of first and second load parts is loaded with paper sheets.

According to an aspect of the present invention, the first and second lifting units are controlled to lift both of the first and second load parts when paper sheets are simultaneously loaded on the first and second load parts in a shared manner, and to lift only the first load part when the paper sheets are separately loaded on the first and second load parts, and the paper transfer unit is controlled to transfer paper sheets on the second load part to the first load part when only the second load part is loaded with paper sheets.

According to an aspect of the present invention, the side guide part comprises a first side guider and a second side guider for guiding side edges of paper sheets in the first load part; and an associational operation part for operating the first side guider in association with the second side guider. The associational operation part is provided with a first rack formed on the first side guider; a second rack formed on the second side guider; and a pinion pivotably installed between the first and second racks and geared with the first and second racks.

According to an aspect of the present invention, the first and second load parts comprise first and second paper load plates capable of lifting up and down between a first position and a second position at an upstream and a downstream, respectively in a paper feeding direction, and accommodating paper sheets thereon, respectively. Here, the first position is lowered position for papers to be loaded on the first and second load plates; the second position is lifted position for the pick up roller of the paper feeding unit to be connected on the first and second load plates.

According to an aspect of the present invention, the first lifting unit is provided with a first lifter for lifting the first load part up and down between a first position and a second position; a first position sensor for detecting the first position of the first load part; and a second position sensor for detecting the second position of the first load part.

The first lifter is provided with a first driving motor having a drive shaft; a first lifting plate having a first driving force transfer shaft with a first accommodation coupling connected to a first coupling formed on the drive shaft of the first driving motor at one end; and a second lifting plate having a second driving force transfer shaft with a second gear mated with a first gear formed on the first driving power transfer shaft. Further, the first position sensor is provided with a first sensing member formed in the paper feeding unit, and a first sensor part installed in the paper feeding cassette to face the first sensing member so as to detect the operation of the first sensing member. Likewise, the second position sensor is provided with a second sending member formed in the first load part, and a second sensor part installed in the paper feeding cassette to face the second sensing member so as to detect the second sensing member.

Alternatively, the first lifting unit can further include a first plate guider for guiding a motion of the first load part. The first plate guider is preferably provided with a pair of rollers rotatably installed at both sides of the first load part, in a paper feeding direction; and a pair of guide grooves formed in the paper feeding cassette to face the rollers, respectively.

The second lifting unit can further include a second lifter for lifting the second load part up and down between a first position and a second position. The second lifter is preferably provided with a second driving motor having a drive shaft; a third lifting plate having a third driving force transfer shaft with a second accommodation coupling coupled to a second coupling connected to the drive shaft of the second driving motor, via a first driving force transfer part; and a fourth lifting plate having a fourth driving force transfer shaft with a fourth gear mated with a third gear installed to the third driving force transfer shaft. Here, the second lifter is further provided with first and a second unidirectional driving force transfer parts installed between the third and fourth gears and the third and fourth driving force transfer shafts, respectively, to allow a torque of the third and fourth gears to be transferred to the third and fourth driving force transfer shafts only when the second driving motor rotates in one direction.

Alternatively, the second lifting unit can include a second plate guider for guiding motion of the second load part. The second plate guider is provided with a pair of rollers rotatably installed at both sides of the second load part, respectively, in parallel with a paper feeding direction; and a pair of guide grooves formed in the paper feeding cassette to face the rollers, respectively.

According to an aspect of the present invention, the paper transfer unit can have a transfer member for moving the rear guide part so that paper sheets on the second load part are transferred to the first load part; and a third position sensor for detecting a position of the rear guide part moved by the transfer member. The transfer member includes a fifth driving force transfer shaft having a third accommodation coupling coupled with a third coupling connected to the drive shaft of the second driving motor, via a second driving force transfer part at one end; a straight line motion conversion part for converting a torque of the fifth driving force transfer shaft into a linear movement to move the rear guide part in a paper feeding direction in a shuttle manner; and a second guide part for guiding motion of the rear guide part. Here, the transfer member can further include a third unidirectional driving force transfer part installed between the third accommodation coupling and the fifth driving force transfer shaft so that a torque of the third accommodation coupling is transferred to the fifth driving force transfer shaft only when the second driving motor rotates in a different direction.

According to an aspect of the present invention, the straight line motion conversion part is provided with at least one drive pulley formed on the fifth driving force transfer shaft; at least one passive pulley installed to the paper feeding cassette; and a timing belt having an accommodation toothed part mated with a toothed part of the rear guide part and connecting the drive pulley with the passive pulley.

According to an aspect of the present invention, the third position sensor is provided with a third sensing member formed on the rear guide part; and a third sensor part installed in the paper feeding cassette to face the third sensing member to detect operation of the third sensing member.

According to an aspect of the present invention, the paper detection unit is provided with a lateral size detection sensor for detecting a lateral width of sheets of paper; a longitudinal size detection sensor for detecting a longitudinal length of sheets of paper; a first load part paper detection sensor for detecting whether the first load part is loaded with paper; and a second load part paper detection sensor for detecting whether the second load part is loaded with paper. The lateral size detection sensor includes a first operation member formed at a lower portion of the side guide part and a first switch having a plurality of switching terminals formed in a motion path of the first operation member in the paper feeding cassette. Further, the longitudinal size detection sensor includes a second operation part formed at a lower portion of the rear guide and a second switch having a plurality of switching terminals formed in a motion path of the second operation member in the paper feeding cassette. The first load part paper detection sensor includes a first sensing hole formed in the first load part, a fourth sensing member formed on a frame of a main body and having a first end portion inserted into the first sensing hole due to its weight or blocked according to whether paper sheets are loaded on the first load part or not, and a fourth sensor part installed to face a second end of the fourth sensing member for detecting operation of the fourth sensing member. The second load part paper detection sensor includes a second sensing hole formed in the second load part, a fifth sensing member formed in the paper feeding cassette and having a first end portion projected outside the second load part or lowered down through the second sensing hole due to its weight, and a fifth sensor part installed to face the second end of the fifth sensing member for detecting operation of the fifth sensing member.

Alternatively, the paper detection unit can further include a separate sensor for detecting a lateral size of paper which can not be detected by the lateral size detection sensor. The separate sensor is provided with a rotational member pivotably installed near the second load part in the paper feeding cassette such that a portion thereof is projected inside a paper load space of the second load part; a sixth sensing member formed to be projected from the rotational member; and a sixth sensor part installed to face the sixth sensing member in order to detect operation of the sixth sensing member of the rotational member. In this instance, the separate sensor can further include a solenoid for rotating the rotational member so that a portion of the rotational member projected inside the paper load space of the second load part is retreated outside the paper load space when the paper transfer unit transfers paper sheets on the second load part to the first load part.

In accordance with another embodiment of the present invention, there is provided a paper feeding method of an image forming device, including (a) checking whether paper sheets are simultaneously loaded on first and second load parts in a paper feeding cassette in a shared manner; (b) lifting at least one of the first and second load parts from a first position to a second position according to the checking result; and (c) picking up and feeding paper sheets into an image forming device sheet by sheet.

According to an aspect of the present invention, step (a) can be performed by checking whether a lateral size detection sensor and a longitudinal size detection sensor are on state; determining such that the paper sheets are simultaneously loaded on the first and second load parts in a shared manner when both of the lateral and longitudinal size detection sensors are on state; and determining such that the paper sheets are separately loaded on the first and second load parts when the lateral size detection sensor is on state and the longitudinal detection sensor is off state. Alternatively, step (a) can be performed by checking whether a lateral size detection sensor, a longitudinal size detection sensor, a second load part paper detection sensor and a separate sensor are on state; determining such that paper sheets are simultaneously loaded on the first and second load parts in a shared manner when the lateral size detection sensor and at least one of the longitudinal size detection sensor, the second load part paper detection sensor and the separate sensor are on state; and determining such that paper sheets are separately loaded on the first and second load parts when any one or all of the lateral size detection sensor; and the second load part paper detection sensor and the separate sensor is/are on state.

According to an aspect of the present invention, step (a) can further include checking whether the first and second load parts are loaded on with the paper sheets when paper sheets are separately loaded on the first and second load parts. The checking whether the first and second load parts are loaded with paper sheets can be performed by determining such that the first load part is loaded with paper sheets when the lateral size detection sensor is on state; determining such that the second load part is loaded with paper sheets when the separate sensor and the second load part paper detection sensor are on state; determining such that the first and second load parts are loaded with paper sheets when the lateral size detection sensor, the second load part paper detection sensor and the separate sensor are on state; and determining such that no one of the first and second load parts are loaded with paper sheets or an error is caused when no one of the sensors is on state. The determining such that no one of the first and second load parts are loaded with paper sheets or an error is caused when no one of the sensors is on state can include alarming a no-paper signal or a paper-error signal or displaying no-paper message or paper-error message on a display device.

According to an aspect of the present invention, the lifting at least one of the first and second load parts from the first position to the second position can be performed by lifting the first and second load parts from the first position to the second position when paper sheets are simultaneously loaded on the first and second load part in the shared manner; and lifting only the first load part from the first position to the second position when paper sheets are separately loaded on the first and second load parts. Here, the first position is lowered position for papers to be loaded on the first and second load parts, the second position is lifted position for the pick up roller of the paper feeding unit to be connected on the first and second load parts.

According to an aspect of the present invention, the lifting only the first load part from the first position to the second position when paper sheets are separately loaded on the first and second load parts can be performed by lifting the first load part from the first position to second position when it is determined that paper sheets are loaded on the first load part or loaded on the first and second load parts; and lifting the first load part from the first position to the second position after transferring paper sheets on the second load part to the first load part when it is determined that paper sheets are loaded on the second load part.

According to an aspect of the present invention, the lifting the first load part from the first position to the second position after transferring paper sheets on the second load part to the first load part can be performed by checking whether a side guide part is in a position where paper sheets on the second load part can be transferred; transferring the paper sheets on the second load part to the first load part; and lifting the first load part from the first position to the second position.

According to an aspect of the present invention, the checking whether side guide part is in the position can be performed by detecting a distance between a second side guider and a second guider of the side guide part by a lateral size detection sensor; and determining whether papers sheets can be transferred according to the distance of the first and second side guiders. Alternatively, when the distance between the first and second side guiders is smaller than a lateral size of paper sheets loaded on the second load part, the determining whether paper sheets can be transferred can further include alarming or displaying such state.

Further, the paper feeding method can further include checking whether all the paper sheets on the first load part are exhausted; and signaling that the paper sheets on the first load part are exhausted or transferring paper sheets on the second load part to the first load part.

The signaling or transferring can be performed by alarming no paper state and/or displaying no paper message on a display device when paper sheets are simultaneously loaded on the first and second load parts or no paper sheets are loaded on the second load part; lowering the first load part from the second position to the first position when it is determined that paper sheets are separately loaded on the first and second load parts and the second load part is loaded with paper sheets; checking whether a side guide part is disposed in a position where paper sheets on the second load part can be transferred; transferring the paper sheets on the second load part to the first load part; and lifting the first load part from the first position to the second position.

In addition to the example embodiments and aspects as described above, further aspects and embodiments of the present invention will be apparent by reference to the drawings and by study of the following descriptions.

BRIEF DESCRIPTION OF THE DRAWINGS

A better understanding of the present invention will become apparent from the following detailed description of example embodiments and the claims when read in connection with the accompanying drawings, all forming a part of the disclosure of this invention. While the following written and illustrated disclosure focuses on disclosing example embodiments of the invention, it should be clearly understood that the same is by way of illustration and example only and that the invention is not limited thereto. The spirit and scope of the present invention are limited only by the terms of the appended claims. The following represents brief descriptions of the drawings, wherein:

DETAILED DESCRIPTION OF THE EMBODIMENTS

Figure 1:
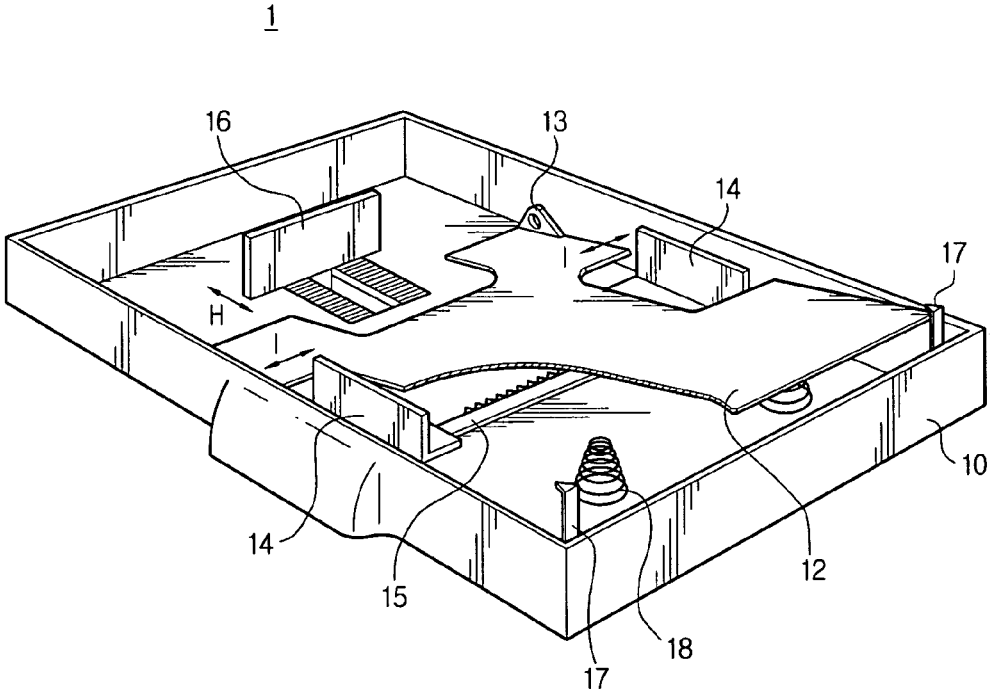
FIG. 1 (PRIOR ART)
FIG. 1 is a partially cut-away perspective view illustrating a conventional paper feeding cassette.

Reference will now be made in detail to the present embodiments of the present invention, examples of which are illustrated in the accompanying drawings, wherein like reference numerals refer to the like elements throughout. The embodiments are described below in order to explain the present invention by referring to the figures.

Figure 2:
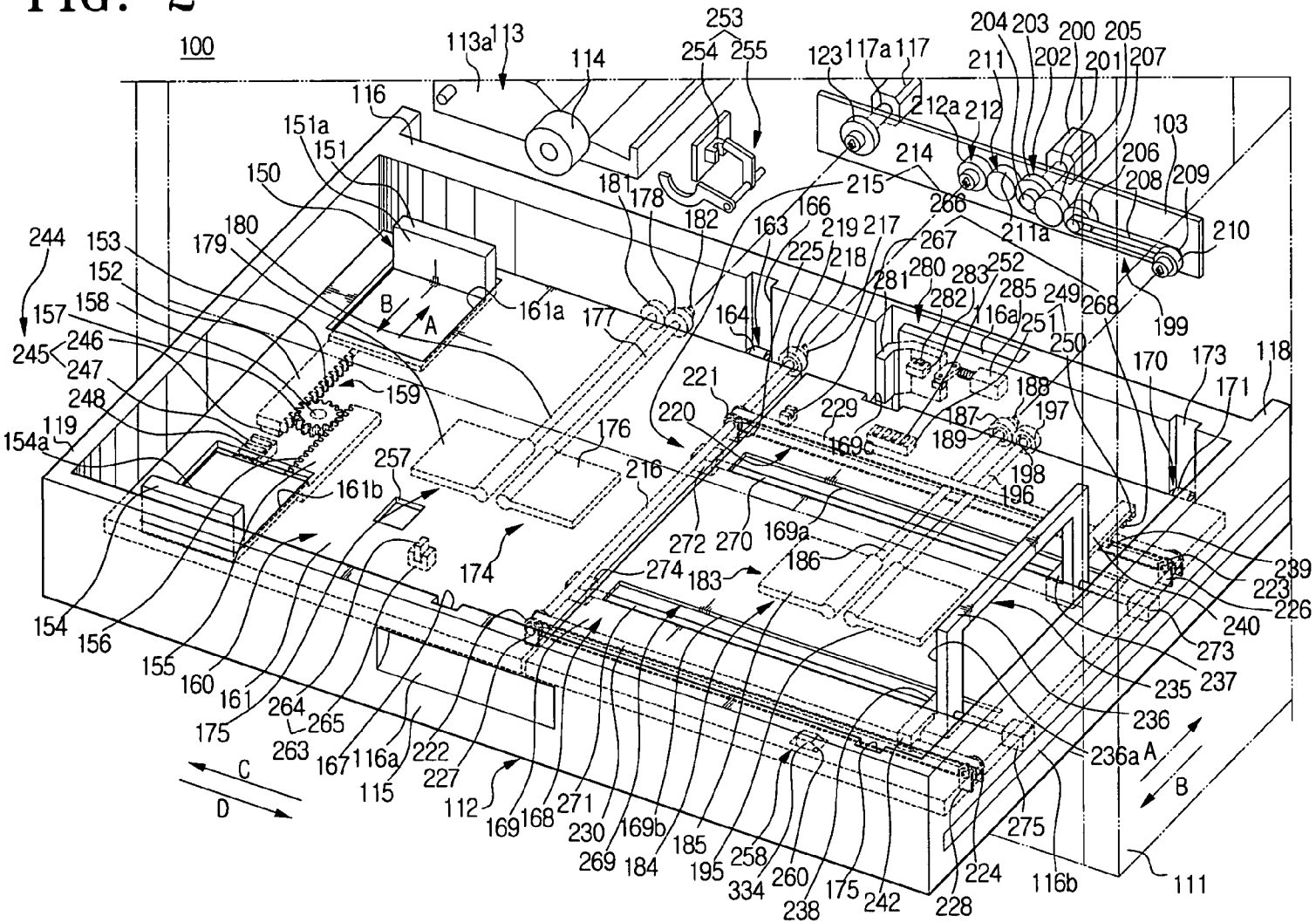
FIG. 2 is a perspective view illustrating a paper feeding apparatus for use in an image forming device according to an embodiment of the present invention.

FIG. 2 illustrates a paper feeding apparatus 100 for use in an image forming device according to one embodiment of the present invention. An image forming device may correspond to a printer, a photocopier, a facsimile machine or a multifunctional product.

As shown in FIG. 2, the paper feeding apparatus 100 includes a paper feeding cassette 112, a first lifting unit 174, a second lifting unit 183, a paper feeding unit 113, a paper transfer unit 214, a paper detection unit 244, and a control unit (not shown). Example embodiments of each of the paper feeding cassette 112, the first lifting unit 174, the second lifting unit 183, the paper feeding unit 113, the paper transfer unit 214, the paper detection unit 244 and the control unit (not shown) are described herein below.

Figure 4:
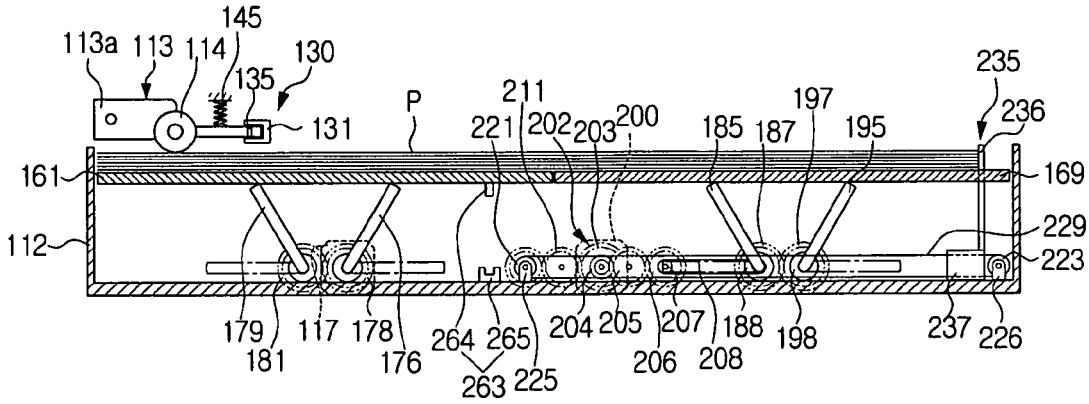
FIG. 4 is a partial sectional view illustrating an operation of first and second lifting units of the paper feeding apparatus shown in FIG. 2, when paper sheets are simultaneously loaded on first and second load parts in a shared manner.
Figure 5:
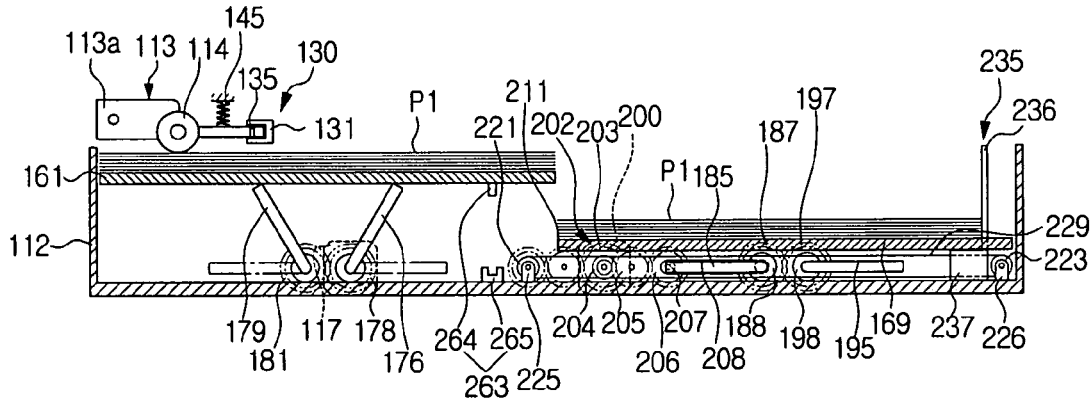
FIG. 5 is a partial sectional view illustrating an operation of first and second lifting units of the paper feeding apparatus shown in FIG. 2, when paper sheets are separately loaded on the first and second load parts.

The paper feeding cassette 112 has a rectangular parallelepiped structure, like a drawer, with a front wall 115, a rear wall 116, a first side wall 118, a second side wall 119 and a bottom plate (120, as shown in FIG. 4 and FIG. 5). A knob 116*a* is provided to the front wall 115, for enabling a user to insert or pull the paper feeding cassette 112 into or out of a main body 111 of the image forming device in the direction of arrows A and B. The first and second side walls 118 and 119 are provided with a first and a second slide groove respectively (only the first slide groove 116*b* of the first side wall 118 is shown herein for brevity), which are engaged with a first and a second projection slider (not shown), respectively, formed on a frame 103 of the main body 111 of the image forming device so that they slidably move along the first and second projection sliders (not shown) when the paper feeding cassette 112 is inserted into or drawn out of the main body 111, via the knob 116*a*.

The paper feeding cassette 112 includes a side guide part 150, a rear guide part 235 and first and second load parts 160 and 168 for defining a paper size to be accommodated in the paper feeding cassette 112.

The side guide part 150 includes first and second guiders 151 and 154 for guiding both sides of paper sheets loaded in the paper feeding cassette 112 and setting a lateral width of the paper sheets, which is perpendicular to a paper feeding direction (the direction of an arrow C). The side guide part 150 also includes an associational operation part 159 for operating the first guider 151 in association with the second guider 154.

The first and second guiders 151 and 154 are formed as an L-shaped panel and have a first and a second side guide face 151*a* and 154*a*, respectively for facing opposing sides of paper sheets. The first and second guiders 151 and 154 are slidably installed on guide grooves (not shown) formed on the bottom plate 120 of the paper feeding cassette 112 such that the first and second guiders 151 and 154 are moved in the direction of the arrows A and B along first and second guide grooves 161*a* and 161*b*, respectively formed on a first paper load plate 161 of the first load part 160.

Lower positions of the first and second guiders 151 and 154 are provided with first and second racks 152 and 155, respectively, having first and second rack gears 153 and 156, for facing each other, and respectively constituting the associational operation part 159. The pinion 157 is engaged with the first and second rack gears 153 and 156, and is pivotably installed on a rotation axis 158 fixed on the bottom plate 120.

Accordingly, when a user defines and sets a paper accommodation size of the paper feeding cassette 112, it is not necessary that both of the first and second side guiders 151 and 154 are moved simultaneously in the direction of the arrows A and B; rather, it is enough that any one of the first and second guiders 151 and 154 is moved. As a result, the first and second guiders 151 and 154 can come close to or become far away from each other due to the associational operation of the first and second racks 152 and 155 of the associational operation part 159 and the pinion 157.

The rear guide part 235 is provided for defining and setting a longitudinal size of paper sheets to be accommodated in the paper feeding cassette 112. The longitudinal size represents a size in a direction parallel with the paper feeding direction. The rear guide part 235 is further provided for guiding rear ends of the paper sheets to be fed into the image forming device, and includes a rear guider 236 having an I-shaped vertical plate with an end guide face 236*a*. The rear guider 236 has first and second sliding blocks 237 and 238 that are movable along third and fourth guide grooves 169*a* and 169*b* formed on a second paper load plate 169 of the second load part 168 at a lower portion of both sides thereof. The first and second sliding blocks 237 and 238 have a first and a second sliding hole (not shown), respectively for receiving first and second sliding bars 270 and 271, respectively so that the first and second sliding blocks 237 and 238 can move along the first and second sliding bars 270 and 271 by the paper transfer unit 214.

The first and second load parts 160 and 168 includes the first and second paper load plates 161 and 169, respectively, that are structured such that paper sheets are separately loaded on the first and second load parts 160 and 168 (hereinafter, referred as "separate load"), respectively or simultaneously loaded across the first and second load parts 160 and 168 in a shared manner (hereinafter, referred as "shared load").

The first and second paper load plates 161 and 169 are installed at a down stream side (left side, as shown in FIG. 2) and an upper stream side (right side, as shown in FIG. 2) of the paper feeding cassette 112 in the paper feeding direction, respectively, so that they can be lifted by the first and second lifting units 174 and 183.

In case of separately loading paper sheets on the first and second paper load plates 161 and 169, paper sheets to be primarily used are loaded on the first paper load plate 161 and redundant paper sheets to be used after the depletion of the paper sheets on the first paper load plate 161 are loaded on the second paper load plate 169. Accordingly, when the image forming device performs an image forming operation (i.e., a printing operation), when the paper sheets on the first paper load plate 161 are depleted, the paper sheets loaded on the second paper load plate 169 can be supplied to the first paper load plate 161 by the paper transfer unit 214 to be described later without having to inconveniently provide additional paper supply.

According to an embodiment of the present invention, the first paper load plate 161 preferably has a size of 305 mm in width and 210 mm in length, and the second paper load plate 169 preferably has a size of 305 in width and 235 mm in length. Accordingly, when separately loading paper sheets on the first and second paper load plates 161 and 169, for example, A4 size (210 mm×297 mm) paper sheets can be loaded on the first and second paper load plates 161 and 169 in a lateral direction. Further, when simultaneously loading paper sheets on the first and second paper load plates 161 and 169 in a shared manner, A4 size (210 mm×297 mm) paper sheets, letter size (216 mm×279 mm) paper sheets, legal size (216 mm×356 mm) paper sheets, B4 size (257 mm×364 mm) paper sheets, A3 size (297 mm×420 mm) paper sheets and ledger size (279 mm×432 mm) paper sheets can be loaded across the first and second paper load plates 161 and 169 in a longitudinal direction.

Figure 3A:
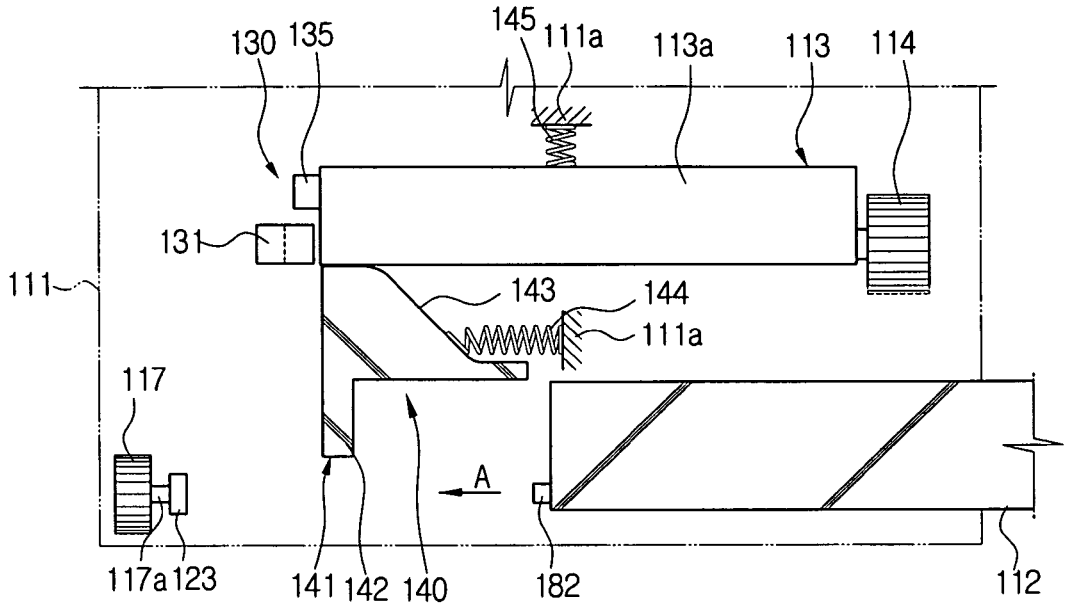
FIG. 3A and FIG. 3B are side views illustrating an operation of a paper feeding unit of the paper feeding apparatus shown in FIG. 2.

The first lifting unit 174 includes a first lifter 175, and first and second position sensors (130, as shown in FIG. 3A) and 263. The first lifter 175 is arranged to lift up and lower down the first paper load plate 161, and includes a first driving motor 117, a first lifting plate 176, and a second lifting plate 179. The first driving motor 117 is installed in the frame 103 of the main body 111 of the image forming device. The first lifting plate 176 includes a first driving force transfer shaft 177 having a first male coupling 182 in a triangle shape installed at its one end. The first male coupling 182 is then coupled to a first female coupling 123 formed in a first drive shaft 117*a* of the first driving motor 117. The second lifting plate 179 includes a second driving force transfer shaft 180 having a second gear 181 installed at its one end. The second gear 181 is then engaged with the first gear 178 formed on the first driving force transfer shaft 177.

Figure 3B:
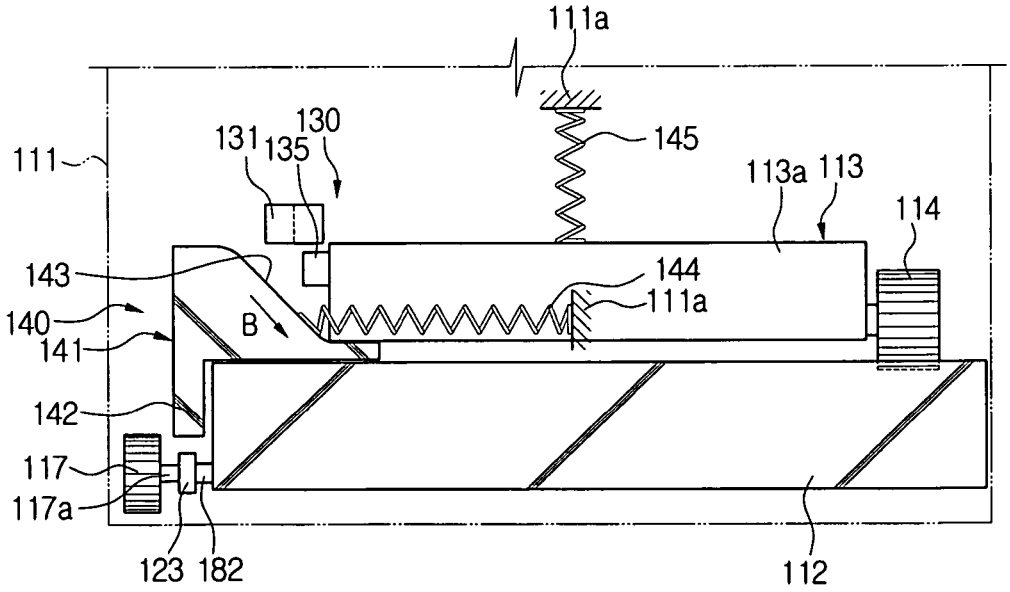

A first position sensor 130 is provided, as shown in FIG. 3A and FIG. 3B, for sensing whether a paper sheet on the first paper load plate 161 is placed on a pick-up position where the paper sheet is in contact with the pick-up roller 114 when the first paper load plate 161 is lifted toward a pick-up roller assembly 113*a*. Such a first position sensor 130 includes a first sensing member 135 and a first sensor part 131.

The first sensing member 135 comprises a projection projected from an end portion of the pick-up roller assembly 113*a*. The first sensor part 131 is installed to the frame 103 to face the first sensing member 135 for detecting operation of the first sensing member 135, and includes a light emitting part and a light receiving part. The light emitting part and the light receiving part can be implemented by a light emitting diode (LED) and a photo-transistor, respectively. The first sensor part 131 outputs a "low" signal, which is an "off" signal, when the pick-up roller assembly 113*a* is lifted and the first sensing member 135 is disposed in an intercepting position between the light emitting part and the light receiving part. Alternatively, the first sensor part 131 outputs a "high" signal, which is an "on" signal, when the pick-up roller assembly 113*a* is lifted up or lowered down and the first sensing member 135 is in an opening position away from the light emitting part and the light receiving part.

The second position sensor 263 is provided for sensing a stop position of the first plate guide 163 when the first plate guide 163 is lowered down. Such a second position sensor 263 includes a second sensing member 264 and a second sensor part 265.

A second sensing member 264, as shown in FIG. 4 and FIG. 5, comprises a projection formed on a lower surface of the first paper load plate 161. The second sensor part 265 is installed on the bottom plate 120 of the paper feeding cassette 112 to face the second sensing member 264, and includes a light emitting part and a light receiving part. The light emitting part and the light receiving part can also be implemented by a light emitting diode (LED) and a photo-transistor, respectively, in the same manner as described in connection with the first sensor part 131. The second sensor part 265 outputs an "off" signal when the first paper load plate 161 is lowered and the second sensing member 264 is disposed in an intercepting position between the light emitting part and the light receiving part. Alternatively, the second sensor part 265 outputs an "on" signal when the first paper load plate 161 is lifted and the second sensing member 264 is disposed in an opening position away from the light emitting part and the light receiving part.

Further, in order for the first paper load plate 161 to be smoothly movable when the first paper load plate 161 is lifted up by the first lifting unit 174, a first guide 163 can be installed between the first paper load plate 161 and the front wall 115 and the rear wall 116 of the paper feeding cassette 112. The first plate guide 163 includes a first and a second roller 164 (only the second roller is shown for brevity) rotationally installed to both sides, respectively, of the first paper plate guide 163, and further includes a first and a second guide groove 166 and 167 formed in the front wall 115 and the rear wall 116 of the paper feeding cassette 112, respectively to face the first and second rollers 164, respectively.

The second lifting unit 183 comprises a second lifter 184 for lifting up the second paper load plate 169 of the second load part 168. The second lifter 184 includes a second driving motor 200, a third lifting plate 185 and a fourth lifting plate 195.

The second driving motor 200 is installed to the frame 103 of the main body 111 of the image forming device. The third lifting plate 185 includes a third driving force transfer shaft 186 to which a third gear 187 having a second male coupling 188 which is a triangle shape is provided. The second male coupling 188 is mated with a second female coupling 210 integrated into a single body with a first passive pulley 209 engaged with a drive gear 202 of the second drive shaft 201 by the first driving force transfer part 199. The first driving force transfer part 199 includes a first driving force transfer gear 205 geared with first teeth 204 of the drive gear 202, a first drive pulley 207 having pulley teeth 206 geared with the first driving force transfer gear 205, and a first passive pulley 209 engaged with the first drive pulley 207 by a driving force transfer belt 208.

A first unidirectional driving force transfer part 189 is installed between the third gear 187 and the third driving force transfer shaft 186 so that only when the second drive shaft 201 of the second driving motor 200, that is, the third gear 187 and the first passive pulley 209, rotates in one direction, i.e. clockwise as shown in FIG. 3, the torque of the first passive pulley 209 is transferred to the third driving force transfer shaft 186.

Figure 6A:
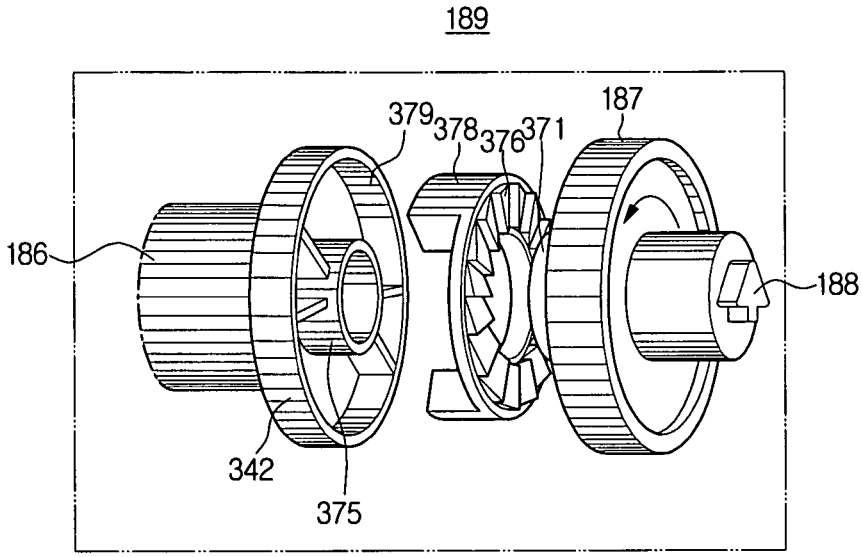
FIG. 6A and FIG. 6B are perspective views illustrating a first unidirectional driving force transfer part of the second lifting unit of the paper feeding apparatus shown in FIG. 2.
Figure 6B:
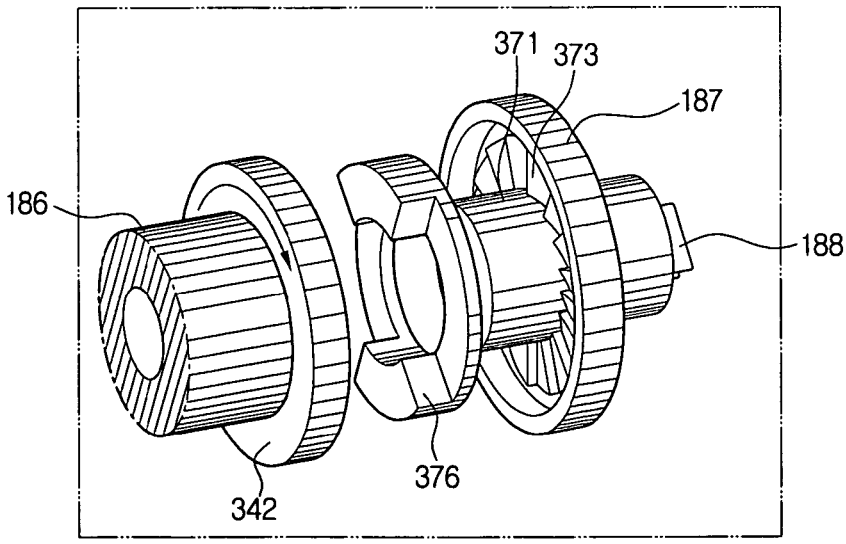

The first unidirectional driving force transfer part 189, as shown in FIG. 6A and FIG. 6B, includes a first rotating boss 371, first latch teeth 373, a first fixing boss 375 and second latch teeth 376. The first rotating boss 371 is formed in the third gear 187. The first fixing boss 375 and the second latch teeth 376 are formed at the side surface of a cylinder 342 formed at an end portion of the third driving force transfer shaft 186. The second latch teeth 376 are rotationally supported by a fixed bracket 378 within a range of predetermined angles in a bracket receiving groove 379 formed at the side surface of the cylinder 342.

The first latch teeth 373 and the second latch teeth 376 are configured such that, when the third gear 187 rotates in one direction, for example, a clockwise direction as shown in FIG. 2 and FIG. 6A, they are geared with each other so that a driving force is transferred from the first latch teeth 373 to the second latch teeth 376. On the other hand, when the third gear 187 rotates in a different direction, for example, a counterclockwise direction, they are not geared so that the driving force is not transferred from the first latch teeth 373 to the second latch teeth 376.

Accordingly, when the third gear 187 rotates in a clockwise direction, as shown in FIG. 2 and FIG. 6A, a driving force of the second driving motor 200 is transferred to the third driving force transfer shaft 186 by the first and second latch teeth 373 and 376; however, when the third gear 187 rotates in a counterclockwise direction, a driving force of the second driving motor 200 is not transferred to the third driving force transfer shaft 186 by the first and second latch teeth 373 and 376.

The fourth lifting plate 195 includes a fourth driving force transfer shaft 196 having a fourth gear 197 geared with the third gear 187 at an end portion thereof.

In order to transfer a torque of the fourth gear 197 to the fourth driving force transfer shaft 196 only when the fourth gear 197 rotates in a different direction, for example, counterclockwise, a second unidirectional driving force transfer part 198 is installed between the fourth gear 197 and the fourth driving force transfer shaft 196.

The second unidirectional driving force transfer part 198 has almost the same structure as the first unidirectional driving force transfer part 189. Therefore, such a second unidirectional driving force transfer part 198 also includes a second rotating boss (not shown), third latch teeth (not shown), a second fixing boss (not shown) and fourth latch teeth (not shown) as described in connection with the first unidirectional driving force transfer part 189, shown in FIG. 6A and FIG. 6B. However, the third and fourth latch teeth can be oriented in an opposite direction to the first and second latch teeth 373 and 376, shown in FIG. 6A and FIG. 6B. Such a different configuration is designed to transfer the torque of the fourth gear 197 to the fourth driving force transfer shaft 196 only when the fourth gear 197 rotates in a different direction, for example, a counterclockwise direction.

Accordingly, when the third gear 187 rotates in a clockwise direction, and the fourth gear 197 geared with the third gear 187 rotates in a counterclockwise direction, a torque of the fourth gear 197 is transferred to the fourth driving force transfer shaft 196; however, when the third gear 187 rotates in a counterclockwise direction, and the fourth gear 197 rotates in a clockwise direction, a torque of the fourth gear 197 is not transferred to the fourth driving force transfer shaft 196.

A second plate guide 170 can be installed between the second paper load plate 169 and the front and rear walls 115 and 116 of the paper feeding cassette 112 in order to make the lift operation of the second paper load plate 169 smooth when the second paper load plate 169 is lifted by the first lifting unit 183. The second plate guide 170 comprises a third roller and a fourth roller (171, only the third roller is shown for brevity) rotatably installed at both sides of the second paper load plate 169, and further comprises third and fourth guide grooves 173 and 175 formed on the front wall 115 and the rear wall 116 of the paper feeding cassette 112 to face the third and fourth rollers 171, respectively.

The paper feeding unit 113, as shown in FIG. 3A and FIG. 3B, includes the pick-up roller assembly 113*a* and the pick-up roller lifting part 140.

The pick-up roller assembly 113*a* includes a pick-up roller 114 for picking up and feeding paper sheet by sheet, when the paper sheets are loaded on the first paper load plate 161, and when the first paper load plate 161 of the first load part 160 is lifted by the first lifting unit 174.

Referring to FIG. 3A and FIG. 3B, the pick-up roller lift part 140 is arranged to lower the pick-up roller 114 of the pick-up roller assembly 113*a* down toward the paper feeding cassette 112 when the paper feeding cassette 112 is inserted into the main body 111 in the direction of the arrow A. The paper feeding cassette 112 is further provided with a male coupling 182 that can be inserted into a female coupling 123 mounted on a driving shaft 117*a* of the first driving motor 117, when the paper feeding cassette 112 is in position for the pick-up roller 114 of the pick-up roller assembly 113*a* to pick-up and feed individual paper sheet for an image formation. The pick-up roller lift part 140 is also arranged to separate the pick-up roller 114 of the pick-up roller assembly 113*a* from the paper feeding cassette 112 when the paper feeding cassette 112 is removed from the main body 111.

The pick-up roller lifting part 140 comprises a lift guide 141, a compression spring 145 and an extension spring 144. The lift guide 141 is installed to be moved by the paper feeding cassette 112 in the main body 111, and includes a guide face 143 for guiding the pick-up roller assembly 113*a* so as to move in the vertical direction. The compression spring 145 is installed between an auxiliary frame 111*a* and the pick-up roller assembly 113*a*, and elastically presses the pick-up roller assembly 113*a* so that the pick-up roller assembly 113*a* comes into contact with the guide face 143 of the lift guide 141. The extension spring 144 is installed to the lift guide 141 and the auxiliary frame 111*a* to lift the pick-up roller assembly 113*a* by restoring the lift guide 141 to its original position when the paper feeding cassette 112 is removed.

The pick-up roller lifting part 140 can be installed in association with the pick-up roller assembly 113*a* and configured to lift and lower the pick-up roller assembly 113*a* up and down by the paper feeding cassette 112, instead of being installed in association with the main body 111 and configured to lift and lower the pick-up roller assembly 113*a* up and down by the paper feeding cassette 112.

The paper transfer unit 214 is provided for transferring paper sheets loaded on the second paper load plate 169 to the first paper load plate 161. Such a paper transfer unit 214 includes a transfer member 215 for pushing paper sheets to a position where the paper sheets are loaded on the first paper load plate 161 through the paper guide face 236*a* of the rear guide 236 and a third position sensor 266 for detecting a position of the rear guide 236 moved by the transfer member 215.

The transfer member 215 includes a fifth driving force transfer shaft 216, a straight line motion conversion part 220 and the second guide part 269.

The fifth driving force transfer shaft 216 is rotatably supported by first and second support brackets 225 and 227, and includes a sixth gear 218 having a third male coupling 217 with a triangle shape at one end. The third male coupling 217 is mated with the third female coupling 212. The third female coupling 212 is mated with the second teeth 213 of a drive gear 202 formed on the second drive shaft 201 of the second driving motor 200, via the second driving force transfer part 211. The second driving force transfer part 211 includes a second driving force transfer gear 211*a* connected between the second teeth 203 of the drive gear 202 and an external gear 212*a* of the third female coupling 212.

The straight line motion conversion part 220 is provided to convert a torque of the fifth driving force transfer shaft 216 to a straight line motion force and transfer the converted force to the rear guide 236 so that the rear guide 236 moves in a shuttle manner in the paper feeding direction (the direction of arrows C and D in FIG. 2). The straight line motion conversion part 220 includes a first toothed part 239, a second toothed part 242, a third drive pulley 221, a fourth drive pulley 222, a third passive pulley 223, a fourth passive pulley 224, a first timing belt 229 and a second timing belt 230. The first and second toothed parts 239 and 242 are C-shaped such that they are engaged with the first and second timing belts 229 and 230, thereby being associated with each other, and provided to the first and second sliding blocks 237 and 238, respectively of the rear guide 236. The third and fourth drive pulleys 221 and 222 are disposed on the fifth driving force transfer shaft 216 by a predetermined distance. The third and fourth passive pulleys 223 and 224 are rotatably supported on the bottom plate 120 of the paper feeding cassette 112 by the fixed brackets 223, 224, near the first side wall 118 of the paper feeding cassette 112. The first and second timing belts 229 and 230 are engaged between the second and third drive pulleys 221 and 222, and the second and third passive pulleys 229 and 224, respectively, and have first and second accommodation teeth (not shown) on inner surface thereof, and the first and second accommodation teeth are engaged with the first and second toothed parts 239 and 242, the third and fourth drive pulleys 221 and 222, and the third and forth passive pulleys 223 and 224, respectively.

The second guide part 269 is arranged to guide the motion of the rear guide 236, and comprises the first and second sliding bars 270 and 271 for guiding the motions of the first and second sliding blocks 237 and 238, respectively. The first and second sliding bars 270 and 271 are fixed to pairs of the third and fourth brackets 272, 273, 274 and 275 at both ends, respectively. The first and second sliding bars 270 and 271 are inserted into the first and second sliding holes of the first and second sliding blocks 237 and 238, and guides motions of the first and second sliding blocks 237 and 238.

A third unidirectional driving force transfer part 219 is installed between the fifth driving force transfer shaft 216 and the sixth gear 218 in order to transfer a torque of the sixth gear 218 to the fifth driving force transfer shaft 216 only when the second drive shaft 201 of the second driving motor 200, i.e. the third female coupling 212, rotates in a different direction, for example, a counterclockwise direction, as shown in FIG. 2.

The third unidirectional driving force transfer part 219 has the same structure as the second unidirectional driving force transfer part 198. Therefore, such a third unidirectional driving force transfer part 219 also includes a third rotating boss (not shown), fifth latch teeth (not shown), a third fixing boss (not shown) and sixth latch teeth (not shown) arranged to transfer a torque of the sixth gear 218 to the fifth driving force transfer shaft 216, only when the sixth gear 218 rotates in a different direction, for example, in a counterclockwise direction.

The third position sensor 226 includes a third sensing member 268 formed at a lower portion of a projection member 240 projected from the first sliding block 237 of the rear guide 236 toward the rear wall 116, and a third sensor part 267 installed on the bottom plate 120 near a border between the first and second paper load plates 161 and 169, in a motion path of the third sensing member 268.

The third sensing member 268 comprises a projection formed at a lower portion of the projection member 240. The third sensor part 267 has the light emitting part and the light receiving part installed on the bottom plate 120 to face the third sensing member 268 for detecting operation of the third sensing member 268. The third sensor part 267 generates an "off" signal when the third sensing member 268 is in an intercepting position between the light emitting part and the light receiving part. Alternatively, the third sensor part 267 generates an "on" signal when the third sensing member 268 is in an opening position disposed away from the light emitting part and the light receiving part.

The paper detection unit 244 is arranged to detect whether the first and second paper load plates 161 and 169 are separately loaded with paper sheets, respectively, and whether paper sheets are simultaneously loaded on the first and second paper load plates 161 and 169 in a shared manner. The paper detection unit 244 includes a lateral size detection sensor 245, a longitudinal size detection sensor 249, the first load part paper detection sensor 253 and a second load part paper detection sensor 258.

The lateral size detection sensor 245 detects a lateral width of loaded paper, i.e., a size of paper in the direction perpendicular to the paper feeding direction. Such a lateral size detection sensor 245 includes a first operation member 246 having a projection shape formed at a lower portion of the first rack 152 of the first side guider 151 and a first switch 247 formed in the moving path of the first operation member 246 on the bottom plate 120 of the paper feeding cassette 112. The first switch 247 comprises a plurality of first switching terminals 248 arranged to be switched "on" and "off" by the first operation member 246 according to the motion of the first rack 152 of the first side guider 151. According to an example embodiment of the present invention, there are five (5) first switching terminals 248 used to detect a variety of lateral paper sizes, such as 210 mm, 216 mm, 257 mm, 280 mm and 297 mm.

The longitudinal size detection sensor 249 detects a size of loaded paper in the direction parallel with the paper feeding direction. Such a longitudinal size detection sensor 249 includes a second operation member 250 having a projection shape formed at a lower portion of an end portion of the projection member 240 of the rear guide 236 and a second switch 251 formed in a motion path of the second operation member 250 on the bottom plate 120 of the paper feeding cassette 112. The second switch 251 comprises a plurality of second switching terminals 252 arranged to be switched "on" and "off" by the second operation member 250 according to the motion of the projection member 240 of the rear guide 236. According to an example embodiment of the present invention, there are four (4) second switching terminals 252 used to detect a variety of longitudinal paper sizes, for example 279 mm, 297 mm, 356 mm and 364 mm.

The first load part paper detection sensor 253 is arranged to detect whether paper sheets are loaded on the first paper load plate 161, and includes a first sensing hole 257, a fourth sensing member 255 and a fourth sensor part 254.

Figure 7A:
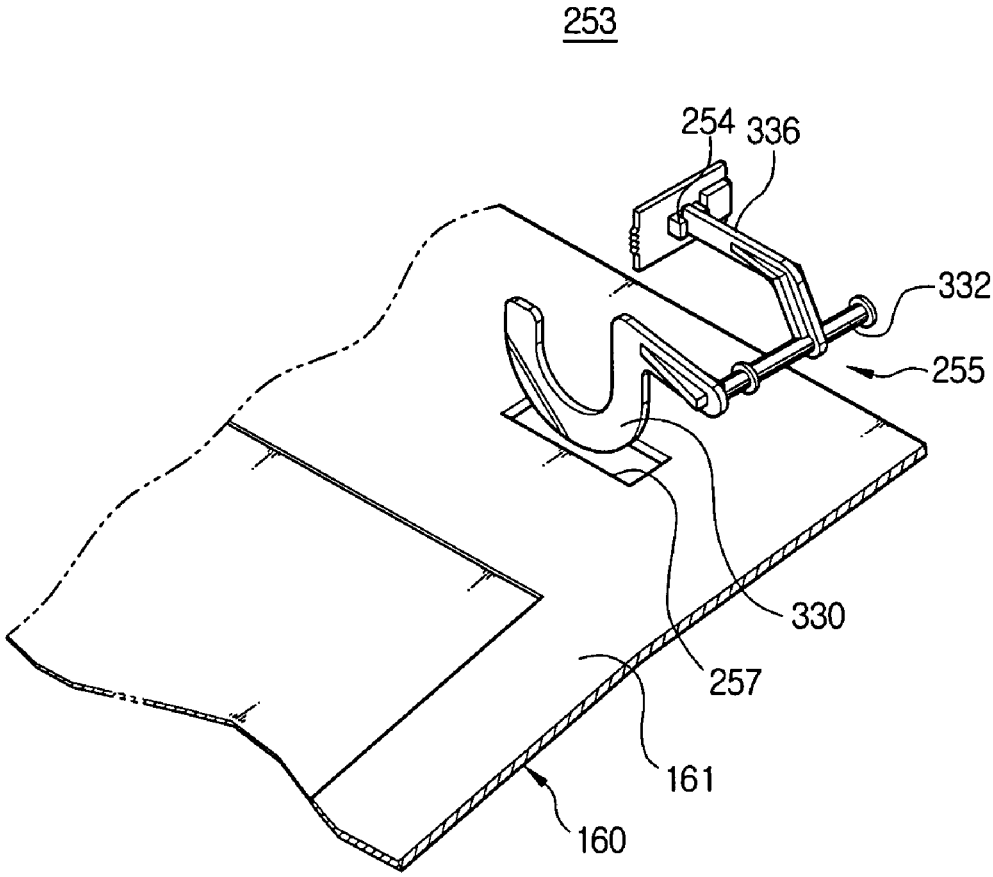
FIG. 7A and FIG. 7B are perspective views illustrating an operation of a first load part paper detection sensor of a paper detection unit of the paper feeding apparatus shown in FIG. 2.
Figure 7B:
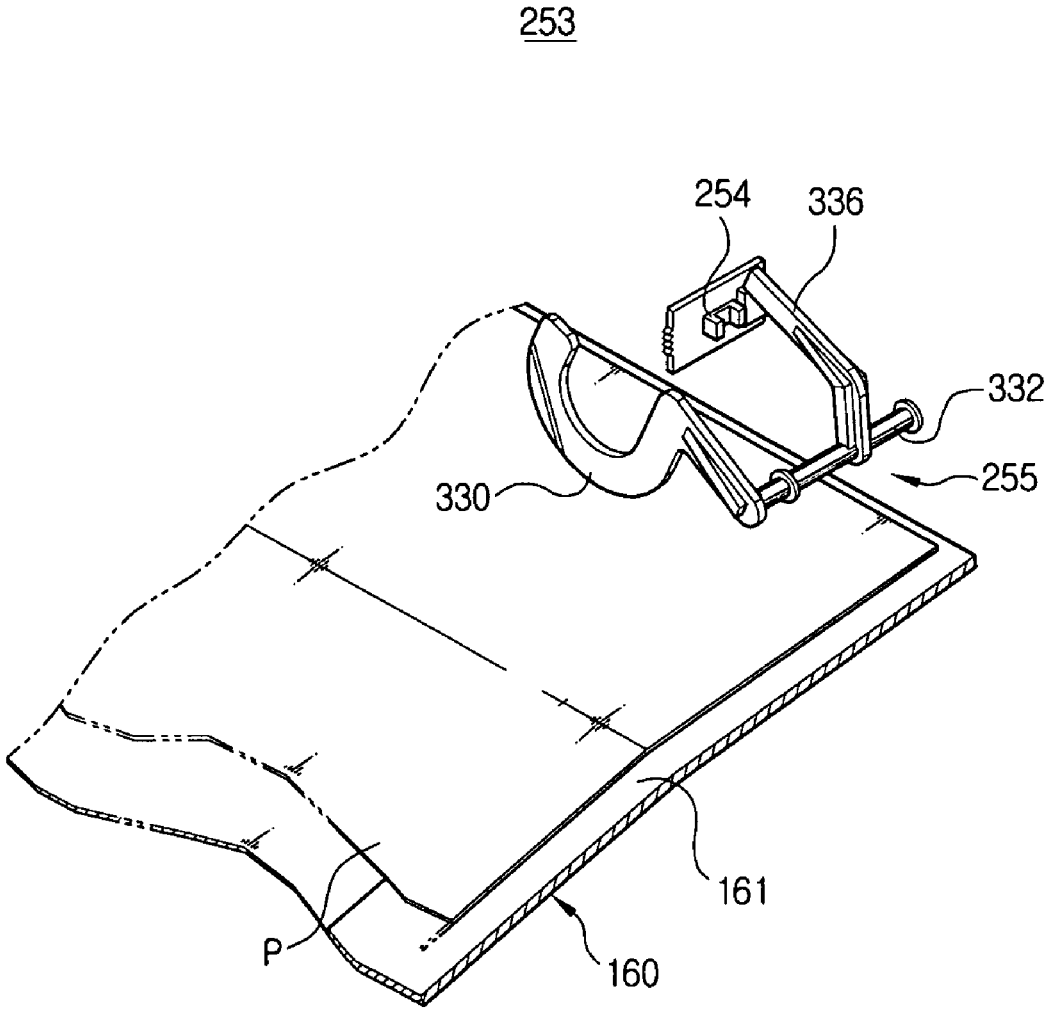

The first sensing hole 257, as shown in FIG. 7A and FIG. 7B, is formed in the first paper load plate 161 of the first load part 160. The fourth sensing member 255 is installed to the frame 103 of the main body 111, and includes a first end portion 330 which is inserted in the first sensing hole 257 by its own weight according to whether paper sheets are loaded or not. The fourth sensor part 254 has the light emitting part and the light receiving part installed to face a second end portion 336 of the fourth sensing member 255 to detect the operation of the forth sensing member 255. The first and second end portions 330 and 336 of the fourth sensing member 255 are rotatably supported by a support bar 332 on the frame 103.

Accordingly, as shown in FIG. 7B, when the first paper load plate 161 is lifted and loaded with paper sheets P, the first end portion 330 of the fourth sensing member 255 is lifted up, and the second end portion 336 of the fourth sensing member 255 becomes disposed in an opening position away from the interception position between the light emitting part and the light receiving part of the fourth sensor part 254. As a result, the fourth sensor part 254 generates an "on" signal. On the contrary, as shown in FIG. 7A, when the first paper load plate 161 is lifted, but not loaded with paper sheets P, the first end portion 330 of the fourth sensing member 255 is projected down form the first paper load plate 161 through the first sensing hole 257 of the first paper load plate 161 due to its weight, and the second end portion 336 of the fourth sensing member 255 moves to the intercepting position between the light emitting part and the light receiving part of the fourth sensor part 254. As a result, the fourth sensor part 254 generates an "off" signal.

The second load part paper detection sensor 258 is arranged to detect whether paper sheets are loaded on the second paper load plate 169, and also detect a longitudinal size of paper which can not be detected by a longitudinal size detection sensor 249, for example, to detect a ledger size having a longitudinal length of 432 mm, and includes a second sensing hole 260, a fifth sensing member 334 and a fifth sensor part 331.

The second sensing hole 260 is formed in the second paper load plate 169 near the first side wall 118. The fifth sensing member 334 is elastically supported by a torsion spring 338 to the fixed bracket 139' on the bottom plate 120, and has a first end portion 259 moving downward or projected upward through the second sensing hole 260 by the paper sheets P. The fifth sensor part 331 has the light emitting part and the light receiving part installed to face a second end portion 335 of the fifth sensing member 334 to detect the operation of the fifth sensing member 335.

Figure 8A:
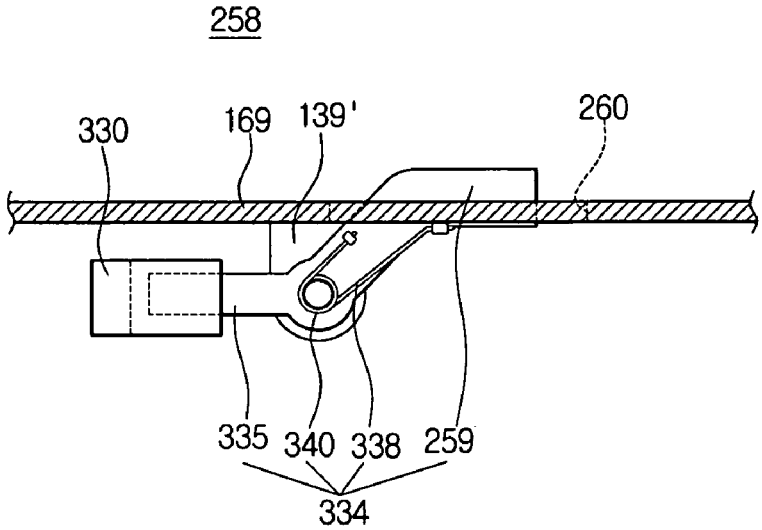
FIG. 8A and FIG. 8B are perspective views illustrating an operation of a second load part paper detection sensor of the paper detection unit of the paper feeding apparatus shown in FIG. 2.
Figure 8B:
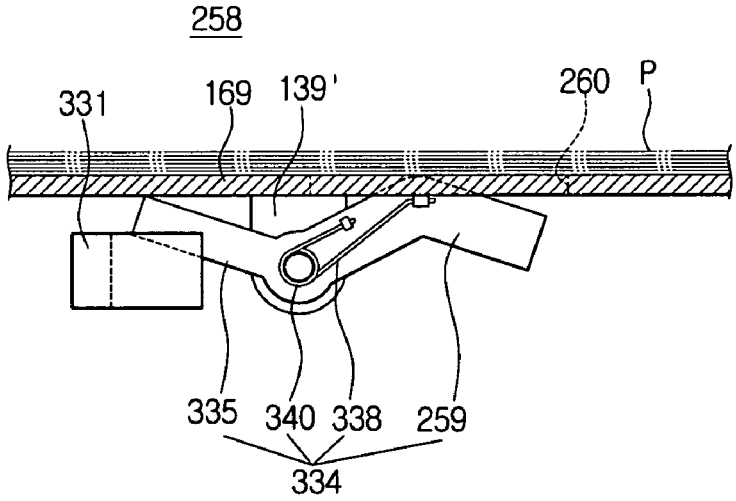

Accordingly, as shown in FIG. 8B, when paper sheets P are loaded on the second paper load plate 169, the first end portion 259 of the fifth sensing member 334 moves down through the second sensing hole 260 due to the weight of the paper sheets P, and the second end portion 335 moves from the intercepting position where a light emitted from the light emitting part is intercepted and can not be received by the right receiving part of the fifth sensor part 331 to the opening position where a light path between the light emitting part and the light receiving part is opened. As a result, the fifth sensor part 331 generates an "on" signal.

On the contrary, as shown in FIG. 8A, if the paper sheets P are run out or removed from the second paper load plate 169, the first end portion 259 of the fifth sensing member 334 is projected upward through the second sensing hole 260 by an elastic force of the torsion spring 338, and the second end portion 335 is returned from the opening position to the intercepting position. As a result, the fifth sensor part 331 generates an "off" signal.

Alternatively, the paper detection unit 244 may further include a separate sensor 280 capable of detecting a large longitudinal size of paper, which can not be detected by the longitudinal size detection sensor 249, together with the second load part paper detection sensor 258, in which the large longitudinal size may represent 420 mm, 432 mm, or more.

Figure 9A:
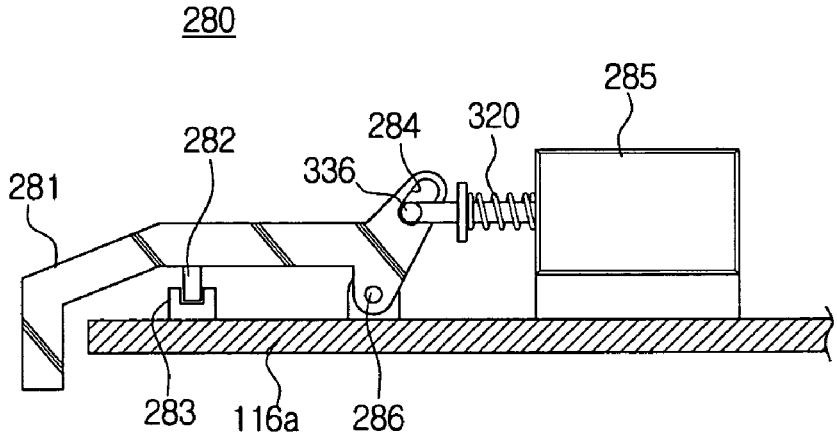
FIG. 9A to FIG. 9C are perspective views illustrating an operation of a separate sensor of the paper detection unit of the paper feeding apparatus shown in FIG. 2.
Figure 9B:
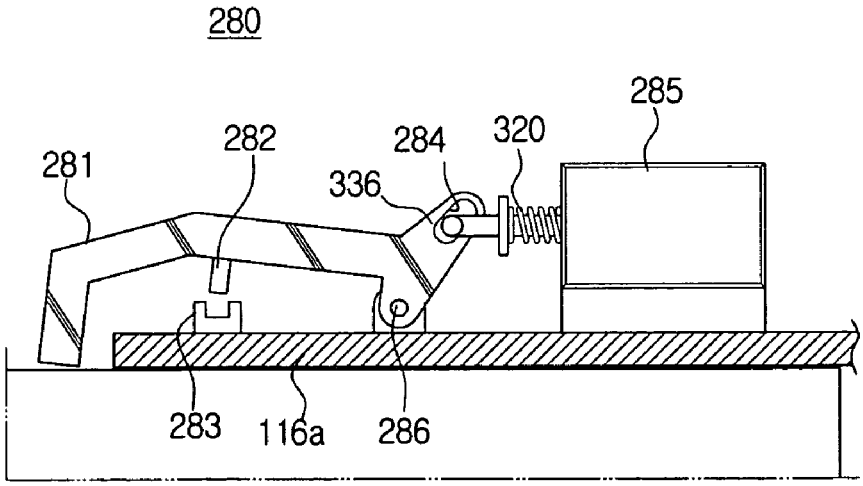

The separate sensor 280 includes a rotational member 281, a sixth sensing member 282 and a sixth sensor part 283. Referring to FIG. 9A and FIG. 9B, the rotational member 281 is pivotably installed to a hinge shaft 286 formed on a paper guide wall 116*a* of the rear wall 116 of the cassette 112, near an opening 169*c* of the second paper load plate 169 so that at least part of the rotational member 281 is projected inside the second paper load plate 169 of the second load part 168. The sixth sensing member 282 comprises a projection projected from an inner surface of the rotational member 281. The sixth sensor part 283 has a light emitting part and a light receiving part installed to the paper guide wall 116*a* to face the sixth sensing member 282 to detect the operation of the sixth sensing member 282.

Accordingly, as shown in FIG. 9B, if a large size of paper such as A3 or ledger size paper is loaded on the first and second paper load plates 161 and 169, the rotational member 281 is pivoted clockwise on the hinge shaft 286 by being pushed by a side edge of the paper. As a result, the sixth sensing member 282 moves from the intercepting position between the light emitting part and the light receiving part of the sixth sensor part 283 to the opening position disposed away from the light emitting part and the light receiving part, and the sixth sensor part 283 generates an "on" signal.

On the contrary, as shown in FIG. 9A, when paper sheets having a smaller size than A3 or ledger size are loaded on the first and second paper load plates 161 and 169, the rotational member 281 is pushed by the compression spring 320 of a solenoid 285 which will be described later and pivoted counterclockwise on the hinge shaft 282, and the sixth sensing member 282 moves from the opening position to the intercepting position. As a result, the sixth sensor part 283 generates an "off" signal.

The separate sensor 280 may further include a solenoid 285 to rotate the rotational member 281 so that a portion of the rotational member 281, the portion being projected into the paper load space of the second paper load plate 169, is retreated outside the paper load space of the second paper load plate 169 in order to prevent the paper sheets from being caught by the rotational member 281 when the paper transfer unit 214 transfers paper sheets loaded on the second paper load plate 169 to the first paper load plate 161.

Figure 9C:
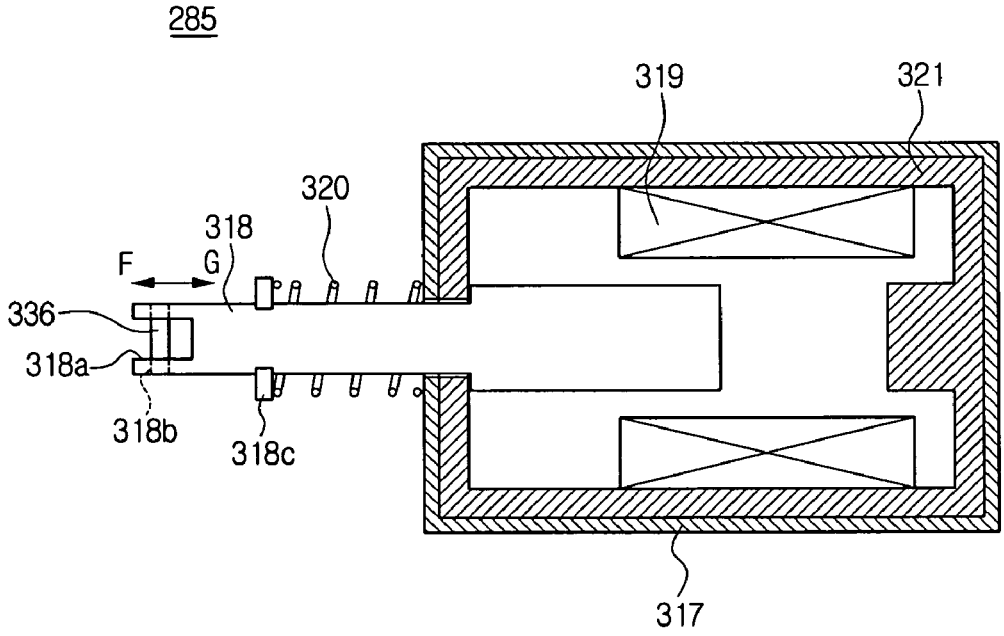
Figure 10:
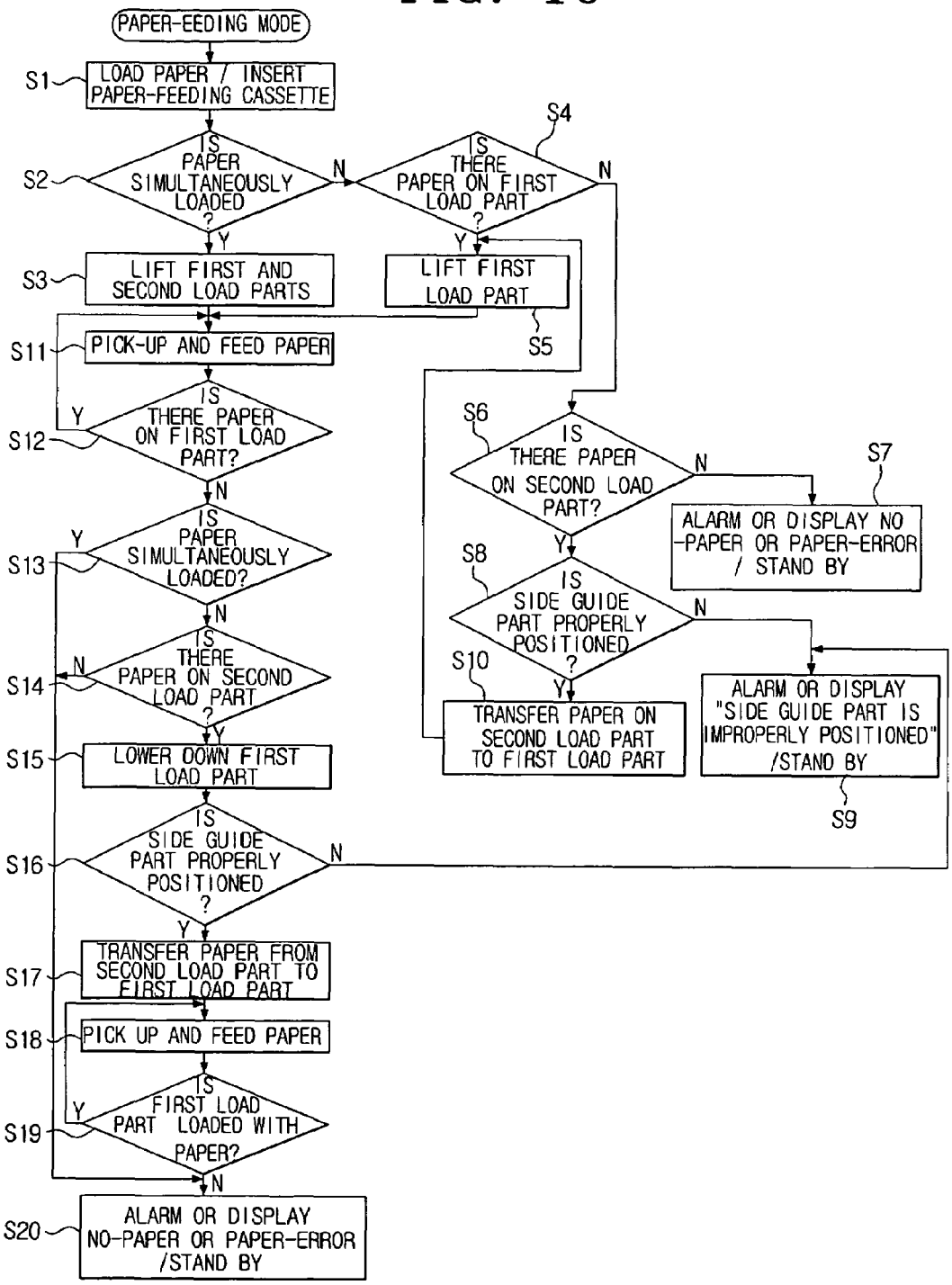
FIG. 10 is a flow chart illustrating paper feeding processes of an image forming device according to an embodiment of the present invention.

Referring to FIG. 9C, the solenoid 285 includes a plunger 318, a coil 319, a compression spring 320 and a casing 317.

The plunger 318 can be made of metal or magnet, and has a fixing hole 318*b*, to which a coupling pin 336 to be inserted into a coupling hole 284 of the rotational member 284 is fixed, and a line-shaped groove 318*a* at an upper portion thereof.

The coil 319 generates the magnetic force when a current is supplied thereto, thereby attracting the plunger 318 and making the plunger 318 move in the direction of an arrow G in FIG. 9C. The coil 319 is supported by a yoke 321.

The compression spring 320 is provided to restore the plunger 318 to its initial position by making the plunger 318 move upward in the direction of an arrow F as shown in FIG. 9C, when a current is not supplied to the coil 319 so that the magnetic force is not generated, and installed between a washer 318*c* of the plunger 318 and an upper portion of the casing 317.

Accordingly, when the solenoid 285 becomes an "on" state, that is, the coil 319 is supplied with a current, the plunger 318 moves in the direction of the arrow G and rotates the rotational member 281 on the hinge shaft 286 in a clockwise direction, as shown in FIG. 9A, via the coupling pin 336 inserted in the coupling hole 284. As a result, as shown in FIG. 9B, a portion of the rotational member 281, the portion being projected inside the paper load space of the second paper load plate 169, is retreated outside the paper load space.

Further, when the solenoid 285 becomes an "off" state, that is, current is not supplied to the coil 319, the plunger 318 moves in the direction of the arrow F by an elastic force of the compression spring 320, and rotates the rotational member 281 counterclockwise, as shown in FIG. 9B, on the hinge shaft 286 via the coupling pin 336 inserted into the coupling hole 284. As a result, as shown in FIG. 9A, the rotational member 281 is partially projected inside the paper load space of the second paper load plate 169.

The control unit (not shown) controls all the components of the image forming device, and comprises a microchip, such as a microprocessor mounted on a printed circuit board (not shown). For example, the control unit (not shown) is electrically connected to the first and second motors 117 and 200, the first, second and third position sensors 130, 263 and 266, the lateral size detection sensor 245, the longitudinal size detection size 249, the separate sensor 280 via a connection means such as a wire (not shown).

The control unit (not shown) checks whether paper sheets are simultaneously loaded on the first and second paper load plate 161 and 169 in a shared manner based on signals output from the sensors 245, 249, 258 and 280 of the paper detection unit 244 after the paper feeding cassette 112 is mounted in the main body 111, and controls the first and/or second lifting units 174 and/or 183 so as to simultaneously lift the first and second paper load plates 161 and 169 or lift only the first paper load plate 171 according to the checking result.

That is, the control unit (not shown) checks whether or not the first and second paper load plates 161 and 169 are simultaneously loaded with paper sheets based on the signals i.e. the "on" signal, output from the sensors 245, 249, 258 and 280 of the paper detection unit 244 as shown in TABLE 1 below.

TABLE 1

| | | | | | | | | | | | | |
|---|---|---|---|---|---|---|---|---|---|---|---|---|
| Lateral Size | 210 mm | 0 | | | | | | | | | | |
| Detection | 216 mm | | 0 | 0 | | | | | | | | |
| Sensor | 257 mm | | | | 0 | | | | | | | |
| (245) | 280 mm | | | | | | 0 | | | | | |
| | 297 mm | | | | | 0 | | | 0 | | | 0 |

TABLE 1-continued

| | | | | | | | | | | | |
|---|---|---|---|---|---|---|---|---|---|---|---|
| Longitudinal Size Detection Sensor (259) | 279 mm | | 0 | | | | | | | | |
| | 297 mm | 0 | | | | | | | | | |
| | 356 mm | | | 0 | | | | | | | |
| | 364 mm | | | | 0 | | | | | | |
| Second Load Part Paper Detection Sensor (258) | | | | | | | 0 | | 0 | 0 | |
| Separate Sensor (280) | | | | | | 0 | 0 | | 0 | 0 | |
| Checking Result | | Simultaneous Load (A4) | Simultaneous Load (Letter) | Simultaneous Load (Legal) | Simultaneous Load (B4) | Simultaneous Load (A3) | Simultaneous Load (Ledger) | Separate Load (A4 only on first paper load plate) | Separate Load (A4 on only second paper load plate) | Separate Load (A4 on both first and second paper load plates | No paper, or Error |

As shown in TABLE 1, "0" represents an "on" signal generated from various detection sensors, such as a lateral size detection sensor 245, a longitudinal size detection sensor 259, a second load part paper detection sensor 258, and a separate sensor 280.

As a result of the checking operation, as shown in FIG. 4, if the paper sheets Pare simultaneously loaded on the first and second paper load plates 161 and 169, the control unit (not shown) controls the first and second lifting units 174 and 183 to simultaneously lift the first and second paper load plates 161 and 169 and position the paper sheets P in a pick-up position where the paper sheets are in contact with the pick-up roller 114 of the pick-up roller assembly 113*a*.

As a result of the checking operation, as shown in FIG. 5, if the paper sheets P are separately loaded on the first and second paper load plates 161 and 169, the control unit (not shown) further checks whether the first paper load plate 161 is loaded with paper sheets based on the signal output from the lateral size detection sensor 245, as shown in TABLE 1. If the first plate load plate 161 is loaded with A4 size paper P1, the control unit (not shown) controls the first lifting unit 174 to position the paper P1 on the pick-up position by lifting the first paper load plate 161.

Alternatively, if the first paper load plate 161 is loaded with the paper P1, which is A4 size paper, based on the signal output from the lateral size detection sensor 245, the control unit (not shown) further can check whether the second paper load plate 169 is loaded with paper P1, for example A4 size paper, based on the signals output from the separate sensor 280 and the second load part paper detection sensor 258. If the second paper load plate 169 is loaded with paper P1, the control unit (not shown) can control the second lifting unit 183 to lift the second paper load plate 169.

If the first paper load plate 161 is not loaded with A4 size paper based on the signal output from the lateral size detection sensor 245, and the second paper load plate 169 is load with A4 size paper based on the signals output from the second load part paper detection sensor 258 and the separate sensor 280, the control unit (not shown) controls the paper transfer unit 214 to transfer paper P1 loaded on the second paper load plates 169 to the first paper load plate 161. However, if both of the first and second paper load plates 161 and 169 are not loaded with paper P1, the control unit (not shown) generates a no-paper signal or a paper error signal using a speaker (not shown) installed in the main body 111 or a display device, such as an LCD device on which "no paper" or "paper error" message is displayed on a control panel to inform a user of such.

Further, when the paper is fed by the pick-up roller 114, the control unit (not shown) checks whether paper is loaded on the first paper load plate 161 based the signal output from the first load part paper detection sensor 253. In this instance, if the paper on the first paper load plate 161 is depleted, the control unit (not shown) can control the paper transfer unit 214 to transfer the paper P1 on the second paper load plate 169 to the first paper load plate 161, or can provide a user a no-paper sign or a paper error sign by using a speaker (not shown) installed in the main body 111 or a display device by displaying "no paper" or "paper error" message on the display device (not shown) of the control panel according to the determination whether the second paper load plate 169 is loaded with paper P or not.

That is, if the paper on the first paper load plate 161 is depleted, in the state in which the paper is simultaneously loaded on the first and second paper load plates 161 and 169 in a shared manner, the control unit (not shown) provides a user a no-paper sign or a paper error sign by using a speaker (not shown) installed in the main body 111 or using a display device.

However, if the paper on the first paper load plate 161 is depleted, in the state in which the paper is separately loaded on the first and second paper load plates 161 and 169, the control unit (not shown) controls the first lifting unit 174 to lower the first paper load plate 161, and checks whether the paper P1 on the second paper load plate 169 is in a position where the paper P1 can be transferred by checking positions of the first and second side guiders 151 and 154, that is, by checking a distance between the first and second side guiders 151 and 154, based on the signal output from the lateral size detection sensor 245, when paper P1, for example A4 size paper, is loaded on the second paper load plate 169 based on the signals output from the second load part paper detection sensor 258 and the separate sensor 280. As a result of the checking, if the first and second side guiders 151 and 154 are positioned not to hinder the paper transfer operation, the control unit (not shown) controls the paper transfer unit 214 to transfer the paper P1 loaded on the second paper load plate 169 to the first paper load plate 161. After the paper P1 is transferred to the first paper load plate 161, the control unit (not shown) controls the first lifting unit 174 to lift the first paper load plate 161 up so that the paper P1 is positioned on the pick-up position. Next, the control unit (not shown) controls the pick-up roller driving motor (not shown) for driving the pick-up roller 114 to feed the paper sheet by sheet into the main body 111 by picking up the paper P1 by the pick-up roller 114.

As described above, since the paper feeding apparatus of an image forming device according to the present invention includes the first and second lifting units 174 and 183 capable of simultaneously or separately lifting and lowering the first and second paper load plates 161 and 169 according to the paper size detection signal from the paper detection unit 244, it is possible to simultaneously load a large size of paper sheets on the first and second paper load plates 161 and 169 in a shared manner, or to separately load a small size of paper sheets on the first and second paper load plates 161 and 169.

Further, since the paper feeding apparatus 100 of the image forming device according to the present invention includes the associational operation part 159 capable of operating the first and second side guiders 151 and 154 in association with each other, it is possible to easily defining and setting a paper accommodation size of the paper feeding cassette 112.

Since the paper feeding apparatus 100 of the image forming device according to an embodiment of the present invention includes the first and second paper load plates 161 and 169 capable of simultaneously or separately accommodating paper sheets, and the paper transfer unit 214 capable of automatically transferring paper sheets loaded on the second paper load plate 169 to the first paper load plate 161, if the paper sheets on the first paper load plate 161 is exhausted when using paper sheets having a small size such as A4 size, it is possible to transfer the paper sheets on the second paper load plate 169 to the first paper load plate 161 by the paper transfer unit 214 without inconvenience of additionally supplying paper sheets in the paper feeding cassette 112.

As described above, the paper feeding apparatus 100 of the image forming device according to an embodiment of the present invention is configured such that redundant paper sheets of A4 size are loaded on the second paper load plate 169, albeit, the paper size is not limited thereto, and the present invention is not limited to the explanation provided. That is, according to an embodiment of the present invention, the first and second paper load plates 161 and 169 are structured to accommodate redundant paper sheets having a different size, for example B5 size, instead of A4 size thereon.

The operation of the paper feeding apparatus 100 of the image forming device according to an embodiment of the present invention will now be described with reference to FIGS. 2 to 10.

First, after paper sheets are loaded in the paper feeding cassette 112, the first and second side guiders 151 and 154 and the rear guider 236 are moved to guide and set both side edges and a rear edge of the paper sheets loaded in the paper feeding cassette 112.

Next, the paper feeding cassette 112 is pushed in the direction of the arrow A by using the knob 116*a*, so that it is inserted into the main body 111 of the image forming device, as shown in FIG. 2, at block S1. In this instance, the first and second slide grooves 161*a* and 161*b* of the paper feeding cassette 112 are guided and move along the first and second projection sliders, and the projection 142 of the lift guider 141 is pushed in the direction of the arrow A by the front end of the paper feeding cassette 112 as shown in FIG. 3A. As a result, the pick-up roller assembly 113*a* positioned above the paper feeding cassette 112 is lowered down, as shown in FIG. 3B, while rotating around a rotation shaft along the guide face 143 of the lift guider 141 by the compression spring 145 in the direction of the arrow E.

Next, when the paper feeding cassette 112 is completely inserted into the main body 111 of the image forming device, the pick-up roller 114 of the pick-up roller assembly 113*a* is positioned above the front end of the paper loaded in the paper feeding cassette 112, and the first, second and third male couplings 182, 288 and 217 installed to the first, third and fifth driving force transfer shafts 177, 186 and 216, respectively, to be projected outside the paper feeding cassette 112 are engaged with the first, second and third female couplings 123, 210 and 212, respectively.

In this state, the control unit (not shown) checks whether paper sheets are simultaneously loaded on the first and second paper load plates 161 and 168 in a shared manner based on the signals output from the lateral size detection sensor 245, the longitudinal size detection sensor 249, the second load part paper detection sensor 258 which constitute the paper detection sensor 244, and the separate sensor 280 at block S2.

Based on the checking result at block S2, if paper sheets having A3 size are simultaneously loaded on the first and the second paper load plates 161 and 169 in a shared manner, as shown in TABLE 1, based on the "on" signals output from the lateral size detection sensor 245 of the paper detection sensor 244 and the separate sensor 280, the control unit (not shown) controls the first and second driving motors 117 and 200 in one direction, for example, counterclockwise and clockwise, respectively to simultaneously lift the first and second paper load plates 161 and 169 as shown in FIG. 4, at block S3. In this instance, a driving force of the second motor 200 is transferred to the third and fourth driving force transfer shafts 186 and 196 of the lifting plates 186 and 195, respectively by the first and second unidirectional driving force transfer parts 189 and 198, respectively, but is not transferred to the fifth driving force transfer shaft 216 by the third unidirectional driving force transfer shaft 219. As a result, the first and second paper load plates 161 and 169 are lifted and moved to the pick-up position where the paper P is in contact with the pick-up roller 114 of the pick-up roller assembly 113*a*.

As described above, as the first and second paper load plates 161 and 169 are lifted, the paper P loaded on the first paper load plate 161 pushes up the pick-up roller 14 against the compression spring 145, in the state of being in contact with the pick-up roller 114. Accordingly, the pick-up assembly 113*a* rotates upward along the rotation shaft.

When the pick-up assembly 113*a* is lifted up and disposed on the pick-up position where the paper P and the pick-up roller 114 are in contact with each other, the first sensing member 134 formed on one portion of the pick-up assembly 113*a* is disposed in an intercepting position between the light emitting part and the light receiving part of the first sensor part 131, and the first sensor part 131 generates an "off" signal.

As the fifth sensor part 131 generates the "off" signal, the control unit (not shown) stops the first and second driving motors 117 and 200.

On the other hand, based on the checking result at block S2, if the paper P is separately loaded based on the signals output from the lateral size detection sensor 244, the longitudinal size detection sensor 249, the second load part paper detection sensor 258 and the separate sensor 280, the control unit (not shown) checks whether the paper P1 is loaded on the first paper load plate 161 at block S4.

At block S4, if paper having A4 size is separately loaded on the first paper load plate 161 or the first and second paper load plates 161 and 169 referring to TABLE 1, based on the "on"

signals from the lateral size detection sensor 245; or the lateral size detection sensor 245, the second load part paper detection sensor 258 and the separate sensor 280, the control unit (not shown) controls the first driving motor 117 of the first lifting unit 174 to rotate counterclockwise so that only the first paper load plate 169 is lifted. As a result, as shown in FIG. 5, the first paper load plate 161 is lifted up in the same way as block S3, and is disposed on the pick-up position where the paper P1 is in contact with the pick-up roller 114 of the pick-up roller assembly 113*a* at block S5.

Based on the check result at block S4, if the paper P1 is not loaded on the first paper load plate 161 based on the "off" signals from the lateral size detection sensor 245; or the lateral size detection sensor 245, the second load part paper detection sensor 258 and the separate sensor 280, the control unit (not shown) further checks whether the second paper load plate 169 is loaded with the paper P1 at block S6.

At block S6, as shown in TABLE 1, if the second paper load plate 169 is not loaded with the paper P with A4 size as none of the sensors generates the "on" signal, the control unit (not shown) determines that any one of the first and second paper load plates 161 and 169 are not loaded with the paper P1, provides a user a no paper signal or a paper error signal using a speaker or a display device and stands by so that the user can remedy the problem at block S7.

At block S6, if the paper with A4 size is loaded on the second paper load plate 169 referring to TABLE 1, and based on the "on" signals output from the second load part paper detection sensor 258 and the separate sensor 280, the control unit (not shown) further checks whether the first and second side guiders 151 and 154 of the side guide part 150 are properly positioned based on the signal output from the lateral size detection sensor 245, that is, whether a distance between the first and second side guiders 151 and 154 is greater than a lateral size (297 mm) of A4 size paper at block S8.

At block S8, if the first and second side guiders 151 and 154 of the side guide part 150 are properly positioned, the control unit (not shown) controls the second driving motor 200 to rotate in a different direction, that is, counterclockwise in order to transfer the paper P1 loaded on the second paper to the first paper load plate 161 at block S10. In this instance, a driving force of the second driving motor 200 is transferred to the fifth driving force transfer shaft 216 by the third unidirectional driving force transfer part 219, but is not transferred to the third and fourth driving force transfer shafts 186 and 196 of the third and fourth lifting plates 185 and 195 by the first and second unidirectional driving force transfer parts 189 and 198. As a result, the paper guide face 236*a* of the rear guider 236 pushes the paper P1 loaded on the second paper load plate 169 and transfers the paper P1 to the first paper load plate 161.

Next, if the paper P1 is completely transferred to the first paper load plate 161, the third sensing member 268 of the third position sensor 266 is disposed on the intercepting position between the light emitting part and the light receiving part of the third sensor part 267 and the third sensor part 267 generates an "off" signal.

As the third sensor part 267 generates the "off" signal, the control unit (not shown) stops the second driving motor 200.

At block S8, if the first and second side guiders 151 and 154 of the side guide part 150 are not properly positioned to transfer the paper P1, the control unit (not shown) provides a user information on the improper position of the first and second side guiders 151 and 154 using a speaker or an LCD device and stands by until the user solves the problem at block S9.

At block S5 and block S10, if the first and second paper load plates 161 and 169 or the first paper load plate 161 is lifted up and disposed on the pick-up position where the paper P or P1 is in contact with the pick-up roller 114 of the pick-up roller assembly 113*a*, the control unit (not shown) drives the pick-up roller 114 by the pick-up roller driving motor associated with the pick-up roller 114 via a gear train (not shown), and feeds the paper pressed by the pick-up roller 114, that is, the paper P or P1 loaded on the first paper load plate 161 into the main body 111 of the image forming device sheet by sheet from the uppermost sheet at block S11.

As such, as the paper P or P1 is fed into the main body 111 of the image forming device, if the paper P or P1 loaded on the first paper load plate 161 is completely exhausted, as shown in FIG. 7A, the first end portion 330 of the fourth sensing member 255 of the first load part paper detection sensor 253 is inserted into the first sensing hole 257 of the first paper load plate 161 due to its weight, and the second end portion 336 is moved to the intercepting position between the light emitting part and the light receiving part of the fourth sensor part 254. As a result, the fourth sensor part 254 generates an "off" signal.

As the fourth sensor 254 generates the "off" signal, the control unit (not shown) determines such that the paper P or P1 is not loaded on the first paper load plate 161 at block S12.

After that, the control unit (not shown) checks whether the paper P or P1 is simultaneously loaded on the first and second paper load plates 161 and 168 at block S13.

In this instance, if the paper P is simultaneously loaded, the operation process proceeds to block S20, and the control unit (not shown) provides a user a "no paper" signal or a "paper error" signal using a speaker or an LCD device and stands by so that the user solves the problem at block S20.

However, if the paper P1 is not simultaneously loaded, the control unit (not shown) further checks whether the paper P is loaded on the second paper load plate 169 at block S14.

That is, the control unit (not shown) checks where there is an "on" signals from the second load part paper detection sensor 258 and the separate sensor 285, and then checks whether the second paper load plate 169 is loaded with the paper P1 according to the existence of the "on" signal.

If the control unit (not shown) determines that the second paper load plate 169 is not loaded with the paper P1, the control unit (not shown) performs the operation of block S20.

However, if the control unit (not shown) determines that the second paper load plate 169 is loaded with the paper P1, the control unit (not shown) drives the first driving motor 117 of the first lifting unit 174 to rotate in a different direction, for example, clockwise in order to lower the first paper load plate 161 down. As a result, the first paper load plate 161 is lowered down at block S15.

After that, if the first paper load plate 161 is completely lowered down, the second sensing member 264 of the second position sensor 263 is disposed on the intercepting position between the light emitting part and the light receiving part of the second sensor part 265, and the second sensor part 265 generates an "off" signal.

As the second sensor part 265 generates the "off" signal, the control unit (not shown) further checks whether the first and second side guiders 151 and 154 of the side guide part 150 are properly positioned at block S16.

In this instance, if the first and second side guiders 151 and 154 are improperly positioned, the control unit (not shown) performs the operation of block S9. However, if the first and second side guiders 151 and 154 are properly positioned, the control unit (not shown) controls the paper transfer unit 214 to transfer the paper P1 on the second paper load plate 169 to the first paper load plate 161 at block S17.

Next, the control unit (not shown) drives the pick-up roller 114 by the pick-up drive motor in the same way at block S11, so that the paper P1 is fed into the main body 111 of the image forming device sheet by sheet at block S18.

As the paper P1 is fed into the main body 111 of the image forming device, if the paper P1 on the first paper load plate 112 is depleted, the fourth sensor part 254 of the first load part paper detection sensor 253 generates an "off" signal in the same way as at block S12.

As the fourth sensor part 254 generates the "off" signal, the control unit (not shown) determines that there is no paper on the first paper load plate 161 at block S19, and provides a user a "no paper" message or a "paper error" signal using a speaker or a display device and stands by so that the user solves the problem at block S20.

At blocks S7, S9 and S20, if the "no paper" message or the "paper error" message is provided to the user by way of the speaker or the LCD device, the user pulls the knob 116*a* of the paper feeding cassette 112, so that the paper feeding cassette 112 is exposed outside the main body 111 as the first and second slide groove 116*b* is guided by the first and second projection sliders of the main body 111 of the image forming device.

In this instance, the first, second and third male couplings 182, 288 and 217 installed to the first, third and fifth driving force transfer shafts 177, 186 and 216 are unengaged from the first, second and third female couplings 123, 210 and 212, respectively. As a result, geared force of the first and second driving motors 117 and 200, which is asserted to the first, second and third male couplings 182, 288 and 218, is released, and the first and second paper load plates 161 and 169 are lowered down and restored to its original positions due to their weights.

Further, the lift guider 141 is drawn by the elastic force of the compression spring 144, and the pick-up roller assembly 113*a* is lifted up along the guide face 143 of the lifting guide 141 as shown in FIG. 3B, and then is restored to its original position as shown in FIG. 3A.

After that, the paper P or P1 is loaded on to the first and second paper load plates 161 and 169 in the paper feeding cassette 112 by the user, and blocks S2 to S20 are repeated.

As described above, the paper feeding apparatus according to the present invention provides at least the following advantages.

First, since the paper feeding apparatus includes the paper detection unit 244 for detecting a variety of paper sizes, and the first and second lifting units 174 and 183 capable of separately or simultaneously moving the first and second load parts 160 and 168 in the paper feeding cassette 112 in the vertical direction according to the detected paper size, paper sheets having a variety of paper sizes can be loaded on the first and second paper load plates 161 and 169, that is, a large size of paper sheets can be loaded on the first and second paper load plates 161 and 169 in a shared manner, and a small size of paper sheets can be separately loaded on the first and second paper load plates 161 and 169.

Second, since the paper feeding apparatus includes an associational operation part capable of operating the first and second side guiders 151 and 154 of the side guide part 150 to be in association with each other, the paper size setting within the paper feeding cassette can be easily performed.

Third, since the paper feeding apparatus includes the first and second paper load plates 161 and 169 for accommodating paper sheets in a shared manner or a separated manner, and the paper transfer unit 214 for automatically transferring paper sheets on the second paper load plate 169 to the first paper load plate 161, it has enhanced paper accommodation capacity for paper sheets having a small size, such as A4, and it is possible to supply paper sheets on the second paper load plate 169 to the first paper load plate 161 without any inconvenience of additionally supplying paper sheets when paper sheets on the first paper load plate 161 are completely exhausted.

While the invention has been shown and described with reference to certain embodiments thereof, it will be understood by those skilled in the art that various changes in form and details may be made therein without departing from the spirit and scope of the invention. For example, components of first and second load parts, first and second lifting units, the paper feeding unit, the paper transfer unit and the paper detection unit can be arranged differently. In addition, simple integrated circuits (ICs) can be designed to control operations of the first and second load parts, first and second lifting units, the paper feeding unit, the paper transfer unit and the paper detection unit to reduce cost. Accordingly, it is intended, therefore, that the present invention not be limited to the various example embodiments disclosed, but that the present invention includes all embodiments falling within the scope of the appended claims.

What is claimed is:

1. A paper feeding apparatus of an image forming device, comprising:

a paper feeding cassette having a side guide part for defining and setting a lateral size of paper, a rear guide part for defining and setting a longitudinal size of paper, and first and second load parts arranged at respective portion of the paper feeding cassette for simultaneously or separately accommodating paper sheets;

a first lifting unit arranged to lift the first load part;

a second lifting unit arranged to lift the second load part;

a paper feeding unit arranged to pick-up and feed the paper sheets loaded on the first load part sheet by sheet, when the first load part is lifted up; and a paper transfer unit arranged to transfer paper sheets loaded on the second load part to the first load part, wherein the first and second lifting units are controlled to lift at least one of the first and second load parts according to determination whether paper sheets are loaded simultaneously on the first and second load parts in a shared manner, wherein the paper transfer unit is controlled to transfer paper sheets on the second load part to the first load part according to determination whether each of the first and second load parts is loaded with paper sheets, wherein the first lifting unit comprises:

a first lifter for lifting the first load part up and down between first and second positions;

a first position sensor for detecting the first position of the first load part; and a second position sensor for detecting the second position of the first load part, and wherein the first lifter comprises:

a first driving motor having a drive shaft;

a first lifting plate having a first driving force transfer shaft provided with a first accommodation coupling connected to a first coupling formed at a distal end of the drive shaft of the first driving motor; and a second lifting plate having a second driving force transfer shaft provided with a second gear mated with a first gear formed on the first driving power transfer shaft.

2. The paper feeding apparatus according to claim 1, further comprising:

a paper detection unit arranged to determine whether each of the first and second load parts is loaded with paper sheets, and whether paper sheets are loaded simultaneously on the first and second load parts in a shared manner.

3. The paper feeding apparatus according to claim 1, wherein the first and second lifting units are controlled to lift both of the first and second load parts, when paper sheets are simultaneously loaded on the first and second load parts in a shared manner, and to lift only the first load part when paper sheets are separately loaded on the first and second load parts, and wherein the paper transfer unit is controlled to transfer paper sheets on the second load part to the first load part, when only the second load part is loaded with paper sheets.

4. The paper feeding apparatus according to claim 1, wherein the side guide part comprises:

first and second side guiders for guiding side edges of paper sheets in the first load part; and an associational operation part for operating the first side guider in association with the second side guider.

5. The paper feeding apparatus according to claim 4, wherein the associational operation part comprises:

a first rack formed on the first side guider;

a second rack formed on the second side guider; and a pinion pivotably installed between the first and second racks and geared with the first and second racks.

6. The paper feeding apparatus according to claim 1, wherein the first and second load parts comprise first and second paper load plates capable of lifting up and down between a first position and a second position at an upstream and a downstream, respectively in a paper feeding direction, and accommodating paper sheets thereon, respectively.

7. The paper feeding apparatus according to claim 1, wherein the first position sensor comprises:

a first sensing member formed in the paper feeding unit; and a first sensor part installed in the paper feeding cassette to face the first sensing member so as to detect the operation of the first sensing member.

8. The paper feeding apparatus according to claim 1, wherein the second position sensor comprises:

a second sensing member formed in the first load part; and a second sensor part installed in the paper feeding cassette to face the second sensing member so as to detect the second sensing member.

9. The paper feeding apparatus according to claim 1, wherein the first lifting unit further includes a first plate guider for guiding a motion of the first load part.

10. The paper feeding apparatus according to claim 9, wherein the first plate guider comprises:

a pair of rollers rotatably installed at both sides of the first load part, in a paper feeding direction; and a pair of guide grooves formed in the paper feeding cassette to face the rollers, respectively.

11. The paper feeding apparatus according to claim 1, wherein the second lifting unit includes a second lifter for lifting the second load part up and down between a first position and a second position.

12. A paper feeding apparatus of an image forming device, comprising:

a paper feeding cassette having a side guide part for defining and setting a lateral size of paper, a rear guide part for defining and setting a longitudinal size of paper, and first and second load parts arranged at respective portion of the paper feeding cassette for simultaneously or separately accommodating paper sheets;

a first lifting unit arranged to lift the first load part;

a second lifting unit arranged to lift the second load part;

a paper feeding unit arranged to pick-up and feed the paper sheets loaded on the first load part sheet by sheet, when the first load part is lifted up; and a paper transfer unit arranged to transfer paper sheets loaded on the second load part to the first load part, wherein the first and second lifting units are controlled to lift at least one of the first and second load parts according to determination whether paper sheets are loaded simultaneously on the first and second load parts in a shared manner, wherein the paper transfer unit is controlled to transfer paper sheets on the second load part to the first load part according to determination whether each of the first and second load parts is loaded with paper sheets, wherein the second lifting unit includes a second lifter for lifting the second load part up and down between a first position and a second position, and wherein the second lifter comprises:

a second driving motor having a drive shaft;

a third lifting plate having a third driving force transfer shaft provided with a second accommodation coupling coupled to a second coupling connected to the drive shaft of the second driving motor, via a first driving force transfer part; and a fourth lifting plate having a fourth driving force transfer shaft provided with a fourth gear mated with a third gear installed to the third driving force transfer shaft.

13. The paper feeding apparatus according to claim 12, wherein the second lifter further comprises:

first and second unidirectional driving force transfer parts installed between the third and fourth gears and the third and fourth driving force transfer shafts, respectively, to allow a torque of the third and fourth gears to be transferred to the third and fourth driving force transfer shafts only when the second driving motor rotates in one direction.

14. The paper feeding apparatus according to claim 11, wherein the second lifting unit further comprises a second plate guider for guiding motion of the second load part.

15. A paper feeding apparatus of an image forming device, comprising:

a paper feeding cassette having a side guide part for defining and setting a lateral size of paper, a rear guide part for defining and setting a longitudinal size of paper, and first and second load parts arranged at respective portion of the paper feeding cassette for simultaneously or separately accommodating paper sheets;

a first lifting unit arranged to lift the first load part;

a second lifting unit arranged to lift the second load part;

a paper feeding unit arranged to pick-up and feed the paper sheets loaded on the first load part sheet by sheet, when the first load part is lifted up; and a paper transfer unit arranged to transfer paper sheets loaded on the second load part to the first load part, wherein the first and second lifting units are controlled to lift at least one of the first and second load parts according to determination whether paper sheets are loaded simultaneously on the first and second load parts in a shared manner, wherein the paper transfer unit is controlled to transfer paper sheets on the second load part to the first load part according to determination whether each of the first and second load parts is loaded with paper sheets, wherein the second lifting unit includes a second lifter for lifting the second load part up and down between a first position and a second position, and wherein the second lifting unit further comprises a second plate guider for guiding motion of the second load part, and wherein the second plate guider comprises:

a pair of rollers rotatably installed at both sides of the second load part, respectively, in parallel with a paper feeding direction; and a pair of guide grooves formed in the paper feeding cassette to face the rollers, respectively.

16. The paper feeding apparatus according to claim 12, wherein the paper transfer unit comprises:

a transfer member for moving the rear guide part so that paper sheets on the second load part are transferred to the first load part; and a third position sensor for detecting a position of the rear guide part moved by the transfer member.

17. The paper feeding apparatus according to claim 16, wherein the transfer member comprises:

a fifth driving force transfer shaft having a third accommodation coupling coupled with a third coupling connected to the drive shaft of the second driving motor, via a second driving force transfer part at one end;

a straight line motion conversion part for converting a torque of the fifth driving force transfer shaft into a linear movement to move the rear guide part in a paper feeding direction in a shuttle manner; and a second guide part for guiding motion of the rear guide part.

18. The paper feeding apparatus according to claim 17, wherein the transfer member further comprises a third unidirectional driving force transfer part installed between the third accommodation coupling and the fifth driving force transfer shaft so that a torque of the third accommodation coupling is transferred to the fifth driving force transfer shaft only when the second driving motor rotates in a different direction.

19. The paper feeding apparatus according to claim 17, wherein the straight line motion conversion part comprises:

at least one drive pulley formed on the fifth driving force transfer shaft;

at least one passive pulley installed in the paper feeding cassette; and a timing belt having an accommodation toothed part mated with a toothed part of the rear guide part and connecting the drive pulley with the passive pulley.

20. The paper feeding apparatus according to claim 16, wherein the third position sensor comprises:

a third sensing member formed on the rear guide part; and a third sensor part installed in the paper feeding cassette to face the third sensing member so as to detect operation of the third sensing member.

21. The paper feeding apparatus according to claim 2, wherein the paper detection unit comprises:

a lateral size detection sensor arranged to detect a lateral width of paper sheets;

a longitudinal size detection sensor arranged to detect a longitudinal length of paper sheets;

a first load part paper detection sensor arranged to detect whether the first load part is loaded with paper sheets; and a second load part paper detection sensor arranged to detect whether the second load part is loaded with paper sheets.

22. The paper feeding apparatus according to claim 21, wherein the lateral size detection sensor includes a first operation member formed at a lower portion of the side guide part in the paper feeding cassette, and a first switch having a plurality of switching terminals formed in a motion path of the first operation member in the paper feeding cassette, wherein the longitudinal size detection sensor includes a second operation member formed at a lower portion of the rear guide part in the paper feeding cassette, and a second switch having a plurality of switching terminals formed in a motion path of the second operation member in the paper feeding cassette, wherein the first load part paper detection sensor includes a first sensing hole formed in the first load part, a fourth sensing member formed on a frame of a main body and having a first end portion inserted into the first sensing hole due to its weight or blocked according to whether paper sheets are loaded on the first load part, and a fourth sensor part installed to face a second end of the fourth sensing member so as to detect operation of the fourth sensing member; and wherein the second load part paper detection sensor includes a second sensing hole formed in the second load part, a fifth sensing member formed in the paper feeding cassette and having a first end portion projected outside the second load part or lowered down through the second sensing hole due to its weight, and a fifth sensor part installed to face the second end of the fifth sensing member so as to detect operation of the fifth sensing member.

23. The paper feeding apparatus according to claim 21, wherein the paper detection unit further includes a separate sensor for detecting a lateral size of paper sheets that can not be detected by the lateral size detection sensor.

24. The paper feeding apparatus according to claim 23, wherein the separate sensor comprises:

a rotational member pivotably installed at the second load part in the paper feeding cassette such that a portion thereof is projected inside a paper load space of the second load part;

a sixth sensing member projected from the rotational member; and a sixth sensor part installed to face the sixth sensing member so as to detect operation of the sixth sensing member of the rotational member.

25. The paper feeding apparatus according to claim 24, wherein the separate sensor further includes a solenoid for rotating the rotational member so that a portion of the rotational member projected inside a paper load space of the second load part is retreated outside the paper load space when the paper transfer unit transfers paper sheets on the second load part to the first load part.

* * * * *

UNITED STATES PATENT AND TRADEMARK OFFICE

CERTIFICATE OF CORRECTION

PATENT NO. : 7,618,037 B2
APPLICATION NO. : 11/452208
DATED : November 17, 2009
INVENTOR(S) : Hoon Kang et al.

It is certified that error appears in the above-identified patent and that said Letters Patent is hereby corrected as shown below:

Column 29, Line 5, after "position," delete "and".

Signed and Sealed this

Thirteenth Day of July, 2010

David J. Kappos

David J. Kappos
*Director of the United States Patent and Trademark Office*